US008800227B2

(12) United States Patent
LeBlang

(10) Patent No.: US 8,800,227 B2
(45) Date of Patent: Aug. 12, 2014

(54) CONNECTORS FOR CONCRETE STRUCTURE AND STRUCTURAL INSULATING CORE

(76) Inventor: Dennis LeBlang, Palm Desert, CA (US)

( * ) Notice: Subject to any disclaimer, the term of this patent is extended or adjusted under 35 U.S.C. 154(b) by 16 days.

(21) Appl. No.: 13/437,707

(22) Filed: Apr. 2, 2012

(65) Prior Publication Data

US 2012/0186180 A1 Jul. 26, 2012

Related U.S. Application Data

(63) Continuation-in-part of application No. 12/456,707, filed on Jun. 22, 2009, now Pat. No. 8,161,699, and a continuation-in-part of application No. 12/231,875, filed on Sep. 8, 2008, now Pat. No. 8,176,696.

(51) Int. Cl.

| | |
|---|---|
| ***E04C 1/42*** | (2006.01) |
| ***E04B 2/76*** | (2006.01) |
| ***E04C 3/09*** | (2006.01) |
| ***E04B 1/16*** | (2006.01) |
| *E04B 2/86* | (2006.01) |
| *E04C 3/04* | (2006.01) |

(52) U.S. Cl.

CPC ..... *E04B 1/165* (2013.01); *E04B 2/8641* (2013.01); *E04B 2/8617* (2013.01); *E04B 2/763* (2013.01); *E04C 2003/0473* (2013.01); *E04C 3/09* (2013.01); *E04B 2/8647* (2013.01); *E04B 2/8635* (2013.01)

USPC ..... 52/309.12; 52/309.11

(58) Field of Classification Search

USPC ..... 52/309.7, 309.8, 309.9, 309.11, 309.12, 52/424, 425, 426, 742.13, 742.14

See application file for complete search history.

(56) References Cited

U.S. PATENT DOCUMENTS

| | | | | |
|---|---|---|---|---|
| 4,889,310 | A * | 12/1989 | Boeshart | 249/41 |
| 5,207,045 | A | 5/1993 | Bodnar | |
| 5,279,091 | A | 1/1994 | Williams | |
| 5,566,518 | A | 10/1996 | Martin | |
| 5,809,724 | A | 9/1998 | Bodnar | |
| 5,809,726 | A | 9/1998 | Spude | |
| 5,992,114 | A | 11/1999 | Zelinsky | |
| 6,122,888 | A | 9/2000 | Bodnar | |
| 6,125,608 | A | 10/2000 | Charlson | |
| 6,131,365 | A | 10/2000 | Crockett | |
| 6,134,861 | A | 10/2000 | Spude | |
| 6,240,692 | B1 * | 6/2001 | Yost et al. | 52/426 |
| 6,247,280 | B1 | 6/2001 | Grinshpun | |
| 6,250,033 | B1 | 6/2001 | Zelinsky | |
| 6,293,067 | B1 | 9/2001 | Meendering | |
| 6,378,260 | B1 | 4/2002 | Williamson | |
| 6,401,417 | B1 | 6/2002 | LeBlang | |
| 6,609,340 | B2 | 8/2003 | Moore | |

(Continued)

*Primary Examiner* — Jeanette E Chapman
*Assistant Examiner* — Daniel Kenny

(57) ABSTRACT

The present invention relates to various types of connectors used to form concrete columns and beams using a structural insulating core wall as a mold for forming column and beam molds. Some connectors can extend above the structural insulating core, used as support channels within the column and beam molds or are flange extensions of the support channels. Some connectors have grooves within the inner and outer boards so the connectors can twist and lock into the grooves while other slide within the grooves to form column and beam molds. Many connectors have air gaps at the connector flanges for additional fasteners connections. Other connectors are installed horizontally interlocking the vertical support channels and connectors together. Some connectors are full height connectors while other can be short clip or brackets that attach to other connectors.

11 Claims, 13 Drawing Sheets

(56) References Cited

U.S. PATENT DOCUMENTS

| | | | | |
|---|---|---|---|---|
| 6,698,710 | B1 | 3/2004 | VanderWerf | |
| 6,935,081 | B2 | 8/2005 | Dunn | |
| 6,952,905 | B2 | 10/2005 | Nickel | |
| 6,978,581 | B1 | 12/2005 | Spakousky | |
| 7,028,440 | B2 | 4/2006 | Brisson | |
| 7,231,746 | B2 | 6/2007 | Bodnar | |
| 7,415,805 | B2 | 8/2008 | Nickerson | |
| 8,037,652 | B2 * | 10/2011 | Marshall et al. | 52/309.11 |

* cited by examiner

CONNECTORS FOR CONCRETE STRUCTURE AND STRUCTURAL INSULATING CORE

REFERENCE TO RELATED APPLICATIONS

This application is a continuation-in-part of patent application Ser. No. 12/456,707 filed Jun. 22, 2009 now U.S. Pat. No. 8,161,699 and Ser. No. 12/231,875 filed on Sep. 8, 2008 now U.S. Pat. No. 8,176,696.

FEDERALLY SPONSORED RESEARCH OR DEVELOPMENT

Not Applicable.

PARTIES OR JOINT RESEARCH

Not Applicable.

FIELD OF THE INVENTION

The present invention relates to forming concrete beams and columns within a wall mold system using connectors; between inner and outer rigid boards and a structural insulating core wall of structural supports between spacer blocks or insulation spacers to form beam and columns molds using the wall as a mold. Many different types connectors, channels, flange extensions and materials are used to form additional connections in the wall mold system.

BACKGROUND OF THE INVENTION

Today more and more steel or concrete post and beam buildings are being built. Construction techniques for building walls have been changing significantly including metal channel framing and stay-in-place insulated forms where concrete is installed within these forms.

Rigid insulation boards have been installed on metal channels for years Insulating walls have embedded channels within insulation blocks embedding the metal channels within the rigid insulation. Some insulated concrete forms (ICF's) have embedded plastic connectors within their rigid insulation blocks also separating the rigid foam from the plastic connectors.

There have been various attempts on creating a form mold to pour a concrete column or beam within a wall. Some patents uses metal channels to help reduce the pressure produced by using a rigid foam material to form concrete beam or columns. Another type of patents uses foam blocks with vertical and horizontal chambers to form concrete columns and beams. Another type of panel is a composite panel that uses fiber concrete boards the panel surfaces as well as interior bracing within the panel with rigid foam at the interior. Another type of panel is when the foam molds create a continuous chamber to pour a solid concrete wall.

The creation of a spacer blocks and spacer insulation walls allow various types of horizontal bracing channels and electrical chases or troughs to pass through the wall and concrete columns for additional flexibility and the various connectors to form the walls. In addition the structural insulating wall can be formed with a variety of closed cell rigid insulating materials like polystyrene, cellular light weight concrete or aerated autoclaved concrete all requiring various types of connectors.

DESCRIPTION OF PRIOR ART

A. Foam Block With Holes

In U.S. Pat. No. 7,028,440 (filed Nov. 29, 2003) by Brisson uses foam blocks with vertical holes to form concrete columns and uses a horizontal recess at the top of the panels to form a beam pocket. Since the holes for the concrete only support the foam, the size is limited as the concrete will deform as well as break the foam panels. Again the beam pocket is also fragile as there is not support to stop the wet concrete from deforming the beam.

A. Concrete Column & Beam Using Metal Channels

Panels are formed here using rigid boards and or rigid insulation along with metal channels to form concrete columns or beams. The light gauge framing adds support means for installing drywall or other surface building materials.

In U.S. Pat. No. 6,401,417 by LeBlang shows how a concrete column and beam can be installed within a wall using metal channels and rigid insulation/hard board or as a column and beam within a wall and or as a separate beam using a rigid board between the channels to enlarge the beams or columns.

B. Foam Block with Holes.

In U.S. Pat. No. 6,131,365 (filed Oct. 2, 1998) by Crockett has a wall unit system with a "tie down space" is in the middle of the wall for installing steel reinforcing to create a concrete column and a horizontal concrete beam is installed at the top of the wall. The interior concrete column and beam does not show any prior art plus the interior insulated structural material also does not pertain to the pending patent.

E. Triangular Stud

Light gauge metal is configured in many different shapes and therefore a forming mold should be analyzed with many different shapes.

In U.S. Pat. No. 5,279,091 (filed Jun. 26, 1992) by Williams is a triangular flange and a clip to install a demountable building panel of drywall.

In U.S. Pat. No. 5,207,045 (filed Jun. 3, 1991), U.S. Pat. No. 5,809,724 (filed May 10, 1995), U.S. Pat. No. 6,122,888 (filed Sep. 22, 1998), by Bodnar described a triangular stud and in U.S. Pat. No. 7,231,746 (filed Jan. 29, 2004) by Bodnar shows wall studs that are wrapped and the wall stud is partially embedded into a concrete column are cast and within the framing of a precast wall.

H. Foam Tape on studs

Foam tape is shown on metal and wood channels to reduce the conductivity between different building materials.

In U.S. Pat. No. 6,125,608 (filed Apr. 7, 1998) by Charlson shows an insulation material applied to the flange of an interior support of a building wall construction. The claims are very broad since insulating materials have been applied over interior forming structures for many years. The foam tape uses an adhesive to secure the tape to the interior building wall supports.

J. Plastic or Related Panel Connectors

Connector type patents are typically full width poured concrete walls. The plastic connectors hold the panels together and are made of various configurations.

In U.S. Pat. No. 5,809,726 (filed Aug. 21, 1996), U.S. Pat. No. 6,026,620 (filed Sep. 22, 1998) and U.S. Pat. No. 6,134,861 (filed Aug. 9, 1999) by Spude uses a connector that has an H shaped flange at both ends of the connector and connected by an open ladder shaped web. The connector is not an ICF block type connector, but long and is used both vertically and horizontally within the wall. All the Spude patents refer to a full width poured concrete wall. Sometimes the connector is located at the exterior surface; another is embedded within the panel surface.

In U.S. Pat. No. 6,293,067 (filed Mar. 17, 1998) by Meendering uses the same H shaped flange at both ends of the connector; however the web configuration is different. Also in U.S. Pat. No. 5,992,114 (filed Apr. 13, 1998) & U.S. Pat. No. 6,250,033 (filed Jan. 19, 2000) by Zelinsky also uses the same H shaped flange at both ends of the connector, also uses a different web configuration. Also in U.S. Pat. No. 6,698,710 (filed Dec. 20, 2000) by VanderWerf also uses the same H shaped flange at both ends of the connector, also uses a different web configuration.

In U.S. Pat. No. 6,247,280 (filed Apr. 18, 2000) by Grinshpun has an inner and outer skin which has an interlocking means built-in the interior surface of the panel skins. The ends of a panel connector are V shaped and lock into the interior interlocking means of each of the building panels. The connector also can accommodate a rigid insulation board within the interior of the wall panel. The panel construction is used for a continuous concrete wall, and does not affect this patent application.

In U.S. Pat. No. 6,935,081 (filed Sep. 12, 2003) by Dunn embeds an H shaped configuration in both sides of the wall panel which is rigid insulation. The H shaped configuration also has a recessed area into which a "spreader" can be installed. The spreader is another H shaped member that can slide into the recess of each side of the wall panel.

In U.S. Pat. No. 5,566,518 (filed Nov. 4, 1994) by Martin uses rigid insulation as the sides of the wall panel. The side walls are connected by a snap-on plastic connector that fits over the edge of the side walls. When connected the rigid insulation along with the plastic connector really just form another type of ICF blocks.

In U.S. Pat. No. 6,952,905 (filed Feb. 3, 2003) by Nickel, uses connectors that have dovetail slots where bolts heads fit into and the bolt shafts fit into the stone panels. In U.S. Pat. No. 6,978,581 (filed Sep. 7, 1999) by Spakousky uses dovetail slots with connectors, however the connectors do not allow for additional fasteners to be installed after concrete is installed within the mold and the connectors have a divider with two chambers within the wall. In U.S. Pat. No. 7,415,805 (filed Aug. 26, 2008) by Nickerson uses slit slots or dovetail slots to support the anchors within a wall. Nickerson also uses a tie assembly with a shank, two clamps, a support, saddle and end caps; or a tapered plug to fit into the dovetail slots to secure the block faces.

There are many ICF's manufactured, for example, U.S. Pat. No. 6,378,260, U.S. Pat. No. 6,609,340, just to name a few.

SUMMARY OF THE INVENTION

The present invention relates to an improved wall system where a column and beam mold forming system uses a structural insulating core of metal support channels or connectors with spacer blocks or spacer insulation along with inner and outer boards to form a wall and a wall with column and beam molds. The structural insulating core with connectors between the inner and outer boards forms concrete columns and beams, requiring connectors between the inner and outer boards.

Various types of connectors are shown including the twist connector, twist connect channel, bent flange channel, C channel, U channel and flange extensions that form different shaped connectors but maintain the function of holding the inner and outer boards together and eliminates concrete from entering the connectors or channels. In addition foam material can be added within channels to also eliminate concrete from surrounding the flanges. The horizontal bracing channel connects the structural insulating cores on both sides of the concrete columns as well as connecting the beam to the structural insulating core. A plate can be installed over the horizontal bracing channels forming chase where electric wiring can pass through the concrete columns.

The present invention relates to an improved wall system where a structural insulating core wall uses various wall forming structures and spacer blocks interconnecting between each other. The spacer blocks have vertical and horizontal interlocking tongue and groove connections that connect between the wall forming structure and the spacer blocks. The projections of the spacer blocks cover the flanges of the support channels and the thickness of the projections is the thickness of the inner and outer boards used to form the concrete beams and columns.

DESCRIPTION OF THE PREFERRED EMBODIMENTS

Figure 1:
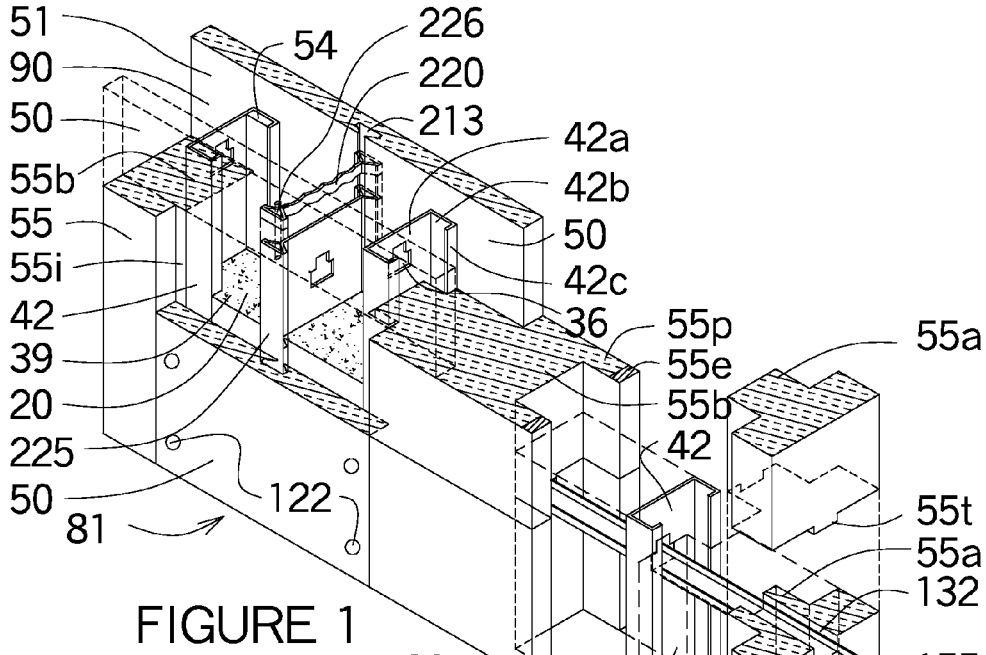
FIG. 1 shows an isometric view of the structural insulating wall where the spacer blocks are wider and interlock between the support channels and horizontal bracing channels and horizontal tongue fit into a trough of the spacer blocks connecting to the support channels together along with the base plate connections to the spacer blocks and support channels. The horizontal bracing channel is connecting the spacer blocks. Concrete column and beams molds shown with various connectors connecting the structural insulating wall together.
Figure 12A:
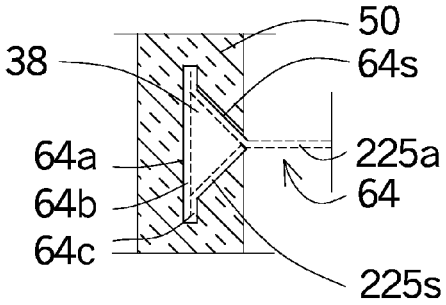
FIG. 12A shows an enlarged view of a twist connector flanges within an inner or outer board.

FIG. 1 shows an isometric view of wall mold 81 where the column molds 20 and beam molds 90 uses spacer insulations 55 fitting between vertical support channel to support and connect the wall mold 81 together. An exploded view on the right side of the isometric drawing shows the support channel as a C channel 42 with a horizontal U channel 155 shown as the horizontal bracing channel passing through the hole 36 in the web 42*a* of the C channel 42. On both sides of the C channel 42 are spacer insulations 55 that have a trough 132 at the top of the spacer insulations 55. The horizontal U channel 155 fits through the hole 36 and into the troughs 132 of the spacer insulation 55. Another spacer insulation 55 is shown above the horizontal U channel 155 where a horizontal tongue 55*t* fits into the trough 132 of the spacer insulations 55 below. The trough 132 is deeper than the horizontal U channel 155 so to allow space for any mechanical/electric utilities to pass through. All the spacer insulations 55 are shown deeper than the length of the web 42*a* of the support channel so projection 55*p* can extend over the flanges 42*b* of the C channel 42. In order to show how the components fit together within the wall mold, the wall mold 81 has been exploded so the various components can be seen separately. The spacer insulations 55 have a tongue shape 55*a* that fits between the lips 42*c* and abut the webs 42*a* and the lip 42*c* of the C channels 42 and a groove shape 55*b* where the groove shape abuts the web 42*a* of the C channel 42 and the projections 55*p* of the spacer insulations 55 extends over the flanges 42*b* of the C channel 42 abutting the adjacent spacer insulations 55. The base plate 120 is shown as a horizontal U channel, however the web 120*a* is secured to a floor and the webs 120*b* are attached to the flanges 42*b* of the C channel 42 and the flanges 42*b* also slide into a groove 121 at the bottom of the spacer insulations 55. The left side of the figure shows three support channels at the column mold 20 where the support channels are the connectors for the column mold 20 and the beam mold 90. The left connector is a C channel 42 with foam material 54 between the web 42*a* and lip 42*c* and against the flange 42*b*. The groove side 55*b* abuts the web 42*a* of the C channel 42 and the spacer insulations 55 has an indentation 55*i*, The middle connector is a twist connector channel 225, more fully explained in FIGS. 11 & 12A located between the rigid board 50 and the rigid insulation 51. In FIG. 12A the flanged head 225*b* is shown recessed into the dovetail groove joint 213. A twist connector 220 is shown above the twist connector channel 225 with a connector rod 226 passing through the cavity 38. The right connector shows a C channel 42 where the tongue side 55*a* of the spacer insulations 55 fits against the web 42*a* and the lip 42*c* and the spacer insulation 55 does not overlap the flange 42*b*. The column mold 20 is complete when the inner and outer board is attached to the three connectors. When the flanges 42*b* of the C channel 42 face into the column mold 20, the inner and outer boards fits against the indentation 55*i* supporting the spacer blocks. In addition the horizontal U channel 155 passes through the spacer insulations 55 on the right side of the column mold 20, the horizontal U channel 155 passes through the holes 36 of the connectors (buried in the concrete 39 of the column mold) and into the spacer insulation 55 on the left side of the column mold 20. Above the spacer insulations 55 on both sides of the column mold 20 is a beam mold 90.

Figure 2:
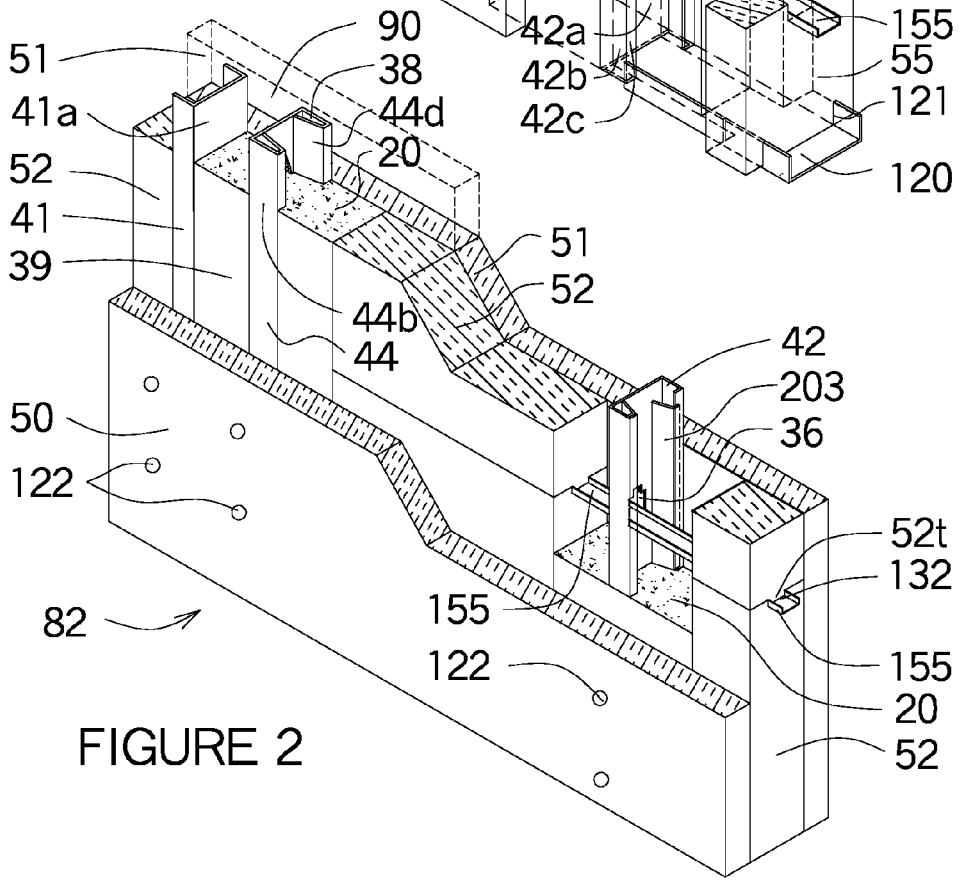
FIG. 2 shows an isometric of the spacer insulation with inner and outer boards and various connectors to connect the inner and outer boards together and to the spacer insulation.

In FIG. 2 is another wall mold where the spacer insulation 52 is between support channels and inner and outer boards cover the spacer insulation 52 and the support channels. The isometric view of wall mold 82 shows two column molds 20 and the left side shows a beam mold 90 above the spacer insulation 52 and the column mold 20. The beam mold 90 shows the rigid insulation 51 in ghost and the rigid board 50 needs to be extended to the height of the rigid insulation 51 to form the opposed side of the beam mold 90. The left column mold 20 show a U channel 41 as both a connector and a wall support for the wall mold 82. The flanges 41*b* enclose the sides of the spacer insulation 52 so fasteners 37 can be attached. The web 41*a* and the spacer insulation on the opposite side form the other sides of the column mold 20. The connector in the middle of the column mold 20 is a bent flange channel 44 more fully described in FIG. 10. No steel reinforcing is shown but can be installed after the wall is installed in a vertical position. Light gauge metal channels have one flange, so the double flanges 44*b* and 44*d* allow two surfaces into which a fastener 37 can attach to and thereby increasing the strength a fastener 37 can attached to support the rigid board 50 as well as resist the force of wet concrete 39 pushing against the rigid board 50. When the wall mold 82 is erected vertically the steel reinforcing 60 is added and the column mold 20 is filled with concrete 39. Upon doing so the web 44*a* and the bent flanges 44*b* & 44*d* create a cavity 38 which is more clearly shown in FIG. 10. Since the cavity 38 is not filled with concrete 39 as typically the small space between the web 44*a* and the bent flange 44*d* is not large enough to allow concrete 39 to flow into. When additional materials shown (in ghost) is applied to the rigid board 50, the fastener (not shown) can then penetrate the rigid board 50 and into the bent flange channel 44 without having to penetrate into the concrete 39 within the column mold 20. Usually C channels or U channels (not shown) are between the column molds 20 to support the wall mold 82 as well as to support the beam molds 90. The column mold 20 on the right side shows the spacer insulation 52 as the side supports for the column mold 20 and the rigid board 50 and rigid insulation 51 support the other two sides of the column mold 20. The connector in the middle of the column mold shows a C channel 42 with flange extension 203 which forms a flange configuration similar to the bent flange channel 44. There are many other flange extensions besides the flange extension 203 shown in FIGS. 13 & 14. The spacer insulation 52 can be full height of a wall or shorter where several spacer insulations fit together to form a full height wall. When several spacer insulations 52 are installed together, a trough 132 of one spacer insulation 52 connects with a horizontal tongue 52*t* of the adjacent spacer insulation above or below the spacer insulation 52. Sometimes a horizontal bracing channel shown here as horizontal U channel 155 passing through the holes 36 of support channels into the trough 132 and the horizontal tongue 52*t* fits into the flanges 155*b*. The horizontal U channel 155 also passes through the column mold 20 for additional support as well as shown as a connector, since it connects both sides of the column mold 20. Since not all sides of the column molds 20 have support channels at the sides of the column molds 20, and the rigid boards 50 and rigid insulation 51 have fasteners 37 attached to the connectors within the column molds 20 as well as the support channels within the structural insulating core wall. The beam mold 90 is formed when the connectors or the support channels extend between and above the spacer insulations 52 and the rigid boards 50 and rigid insulations 51 extend to the top of the beam mold 90 so fasteners 37 can be installed.

Figure 3:
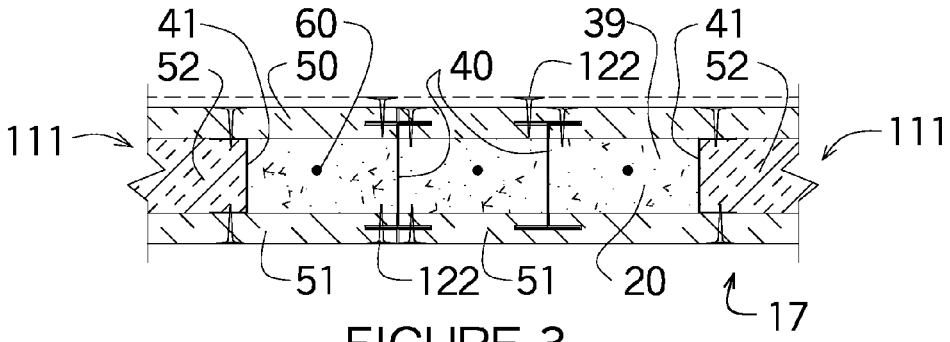
FIG. 3 shows a plan view of H channels and U channels forming a column mold between spacer insulations on both sides of the column mold.

FIG. 3 shows a plan view of wall mold 17 with support channels shown as U channels 141 and spacer insulations 52 on both sides of the column mold 20. The structural insulating core 111 consists of the spacer insulation 52 between the rigid board 50 and rigid insulation 51 with support channels spaced between the spacer insulations 52. The support channels on both ends of the column mold 20 are also considered as a connector since the U channel 41 is part of the column mold 20. Both U channels 41 have the flanges 41*b* facing toward the spacer insulation 52 and the web 41*a* form the sides of the column mold 20. Since the rigid board 50 and the rigid insulation 51 are separate elements to the spacer insulation 52, the inner and outer walls are part of the structural insulating core and the column mold 20. The two connectors shown as H channels 40 have grooves 121 formed into the rigid board 50 and rigid insulation 51. The H channel 40 on the left shows two rigid board 50 and two rigid insulation 51 meeting at the H channel 40 requiring groove 121 to be installed at the edges. The other H channel 40 shows a groove 121 formed as a T shape to conform to the end configuration of the H channel 40. Various screws 122 are used to support the column mold 20 together as well as a means of attaching additional inner and outer boards to the column mold 20 and the structural insulating core. Depending on the size of the column mold 20, additional H channels 40 along with additional rigid board 50 and rigid insulation 51 can be installed between the H channels 40 forming a longer column mold 20.

Figure 4:
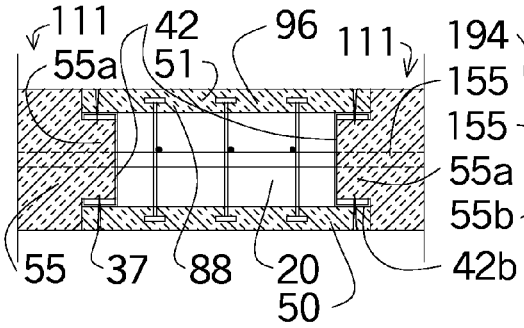
FIG. 4 shows various connectors and where the U channels do not face the column mold.
Figure 5:
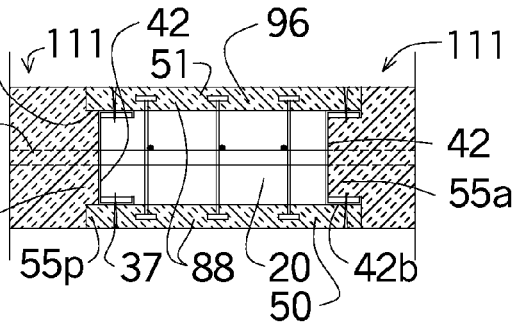
FIG. 5 shows one C channel is embedded into the column mold with rigid foam at the flange.

FIGS. 4 & 5 both show column molds 20 between structural insulating core 111 walls on both sides of the column mold 20. The various connectors shown in FIG. 1, 2 or 3 can be used within the column molds 20 FIGS. 4 & 5. Both FIG's have support channels from the structural insulating core 111 shown at the sides of the column mold 20 and since the C channels 42 are part of the column mold 20 the support channels are also connectors. The C channels 42 in FIG. 4 show the flanges 42*b* and lips 42*c* facing toward the spacer insulations 55 where each C channel 42 is connected by the tongue side 55*a* of the spacer insulations 55. FIG. 5 shows the C channel 42 facing in the same direction causing the C channel 42 on the left side of the column mold 20 to have the groove side 55*b* of the spacer insulation 55 abut the web 42*a* of the support channel. In order to make a strong connection an indentation 194 is installed in the spacer insulation 55. On the right side of the column mold 20, the tongue side 55*a* fits between the flanges 42*b* and the lip 42*c* and extends to the web 42*a* the width extends past the lips 42*c* to the other edge of the spacer insulation 55. The rigid board 50 and the rigid insulation 52 are attached to the flanges 42*b* of the C channel 42. The horizontal U channels 155 are shown passing through the holes 36 shown in FIGS. 1 & 2 connecting the support channels together. The column mold 20 can also be formed as ICF block molds 96 with rigid foam block faces 88 and connectors made of plastic. There are many Insulated Concrete Forms (ICF's) on the market with many different types of connectors. None of the ICF's form column molds 20 nor beam molds 90 (shown if FIGS. 8 & 9) with structural insulating cores 111 on either side using support channels and the horizontal bracing channel as connectors to form column molds 20.

Figure 6:
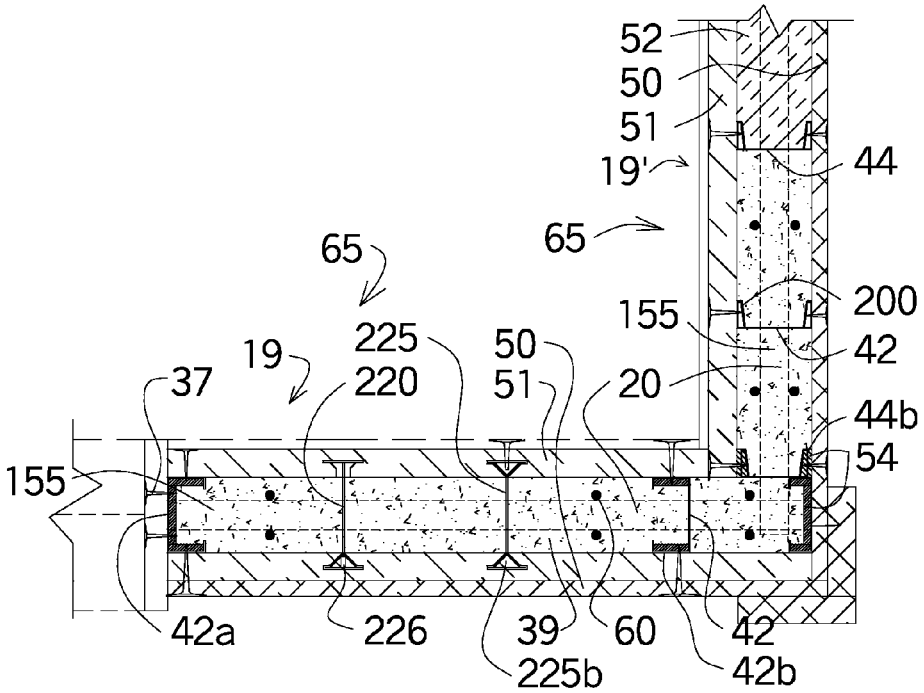
FIG. 6 is a plan view of two panels intersecting forming an "L" shaped column mold and the column showing several types con connectors.

FIG. 6 shows two wall panels 65 intersecting at a corner forming a column mold 20 that is L shaped. The wall panel 65 in wall molds 19 & 19' consists of a rigid board 50 and rigid insulation 51 using connectors between the inner and outer surfaces of wall panels 65. The column molds 20 in each panel form an "L" shape column mold with the various connectors shown in some of the previous figures include: a foam material 54 attached to C channel 42, bent flange channel 44, twist connector 220, twist connector channel 225 and a twist connector rod 226, while another wall panel 65 shown as wall mold 19' has the C channel 42 with flange extensions 200, a bent flange channel 44 connected to the rigid board 50 and rigid insulation 51. A door (shown in ghost) has the foam material 54 shown on the interior side of web 42*a* of the C channel 42 so the door (shown in ghost) can be attached to the wall panel 65 after the concrete 39 has cured. The "L" shaped column mold is partially formed in wall mold 19, and partially formed in wall mold 19'. When the wall mold 19 & 19' are installed vertically and connected together, column mold 20 is formed. Additional steel reinforcing 60 is installed within the column mold 20 and concrete 39 is installed when the walls are erected in a vertical position creating an L shaped column. Typically the column mold 20 would be used when two walls molds intersect at 90 degrees or at any angle. The "L" shaped column at the corner of a building has the integrity of a solid concrete wall or shear wall (more commonly used like diagonal bracing for wind shear), but in not a solid concrete wall since the spacer insulation 52 separates each concrete column 20 within a building structure. The horizontal bracing channel shown as a horizontal U channel 155 passes through the holes of the various connectors connecting the wall panels 65 together.

Figure 7:
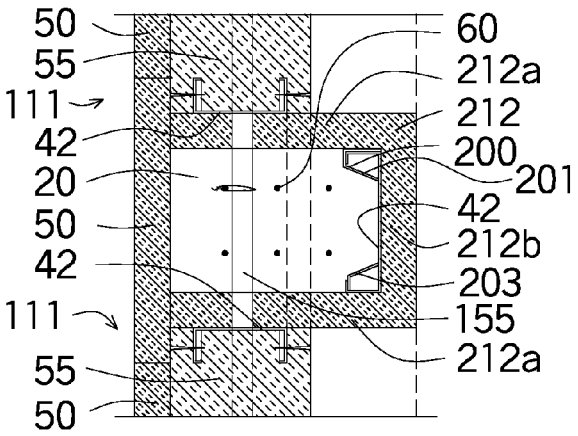
FIG. 7 shows a plan view of the spacer blocks on either side of the column mold that is wider than the column mold with a connector being a C channels with flange extensions and the horizontal bracing channel connecting two sides of the column mold.
Figure 8:
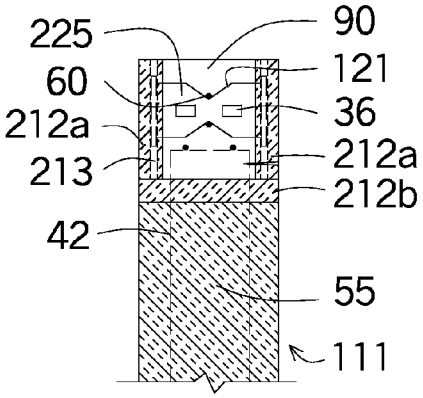
FIG. 8 shows a wall section with a connector attached to the inner and outer wall boards and the support channels extending into the beam mold.

FIG. 7 is a plan view of a column mold 20 comprising of a rigid board 50 and a one piece mold 212 that is U shaped having two sides 212*a* and a back 212*b*. The sides 212*a* of the one piece mold 212 fits between the structural insulating cores shown as spacer insulation 55 and the C channels 42 that extends into the beam mold 90 as shown in FIG. 8 and the one piece mold 212 is installed between the C channels 42 at the sides 212*a* and back 212*b* forming the column mold 20. Another C channel 42 within the one piece mold 212 is used as a connector where flange extensions have been added to form an air gap for easy installation of drywall (not shown). The flange extensions 201 & 203 are shown in the enlarged FIGS. 13 & 14. The one piece mold 212 can be a rigid material like polystyrene or aerated autoclave concrete. The same material shown in the one piece mold 212 is shown as a rigid board 50 installed over the structural insulating cores as well as another rigid board 50 is shown as forming the fourth side of the one piece mold 212. The one piece mold and the rigid board 50 can all be connected to the C channels 42 within the structural insulating core by fasteners 37 (not shown). A horizontal bracing channel shown as a horizontal U channel 155 passes through the one piece mold 212 through the holes in the web of the C channels 42 between the structural insulating cores on both sides of the one piece mold 212 and connected to the vertical reinforcing steel 60.

Figure 9:
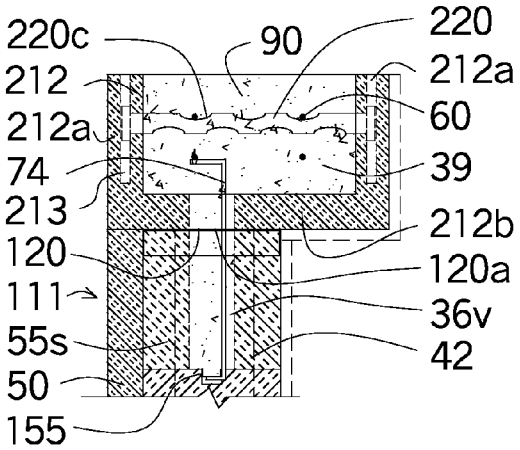
FIG. 9 shows a wall section of a wide column mold above the spacer block with a twist connector and the horizontal bracing channel connected to the beam mold.

FIGS. 7, 8 & 9 are similar as the structural insulating core 111 uses spacer insulation 55 and C channel 42 in both figures and the beam mold 90 and the column mold 20 use the one piece mold 212. Not all rigid boards have similar insulating properties, and therefore must be distinguished to be of different materials. FIGS. 7 & 9 shows the rigid board 50 attached to the structural insulating core 111. The rigid board 50 can either be glued to the structural insulating core or attached with fasteners (not shown) to the C channels 42. The beam mold 90 can be formed as one piece mold 212 or as 3 sided having 2 sides 212*a* and a bottom 212*b*. The one piece mold 212 can be of the same material as the rigid board 50. A base plate 120 shown in FIG. 9 can be installed on top of the structural insulating core 111 so an anchor bolt 74 can be installed through the web 120*a* into the beam mold 90. Concrete 39 and reinforcing steel 60 are installed within the beam mold 90. In FIG. 9 the connector is shown as a twist connector 220 having a dovetail joint 213 within the 2 sides 212*a* of the beam mold 90. The twist connector 220 was shown in FIG. 6 and shown in more detail at FIGS. 12A, 12B & 12C. The smaller spacer insulation 55*s* is shown below the beam mold 90 with a vertical hole 36*v* and an anchor bolt 74 that attaches the horizontal bracing channel shown as a horizontal U channel 155 to the reinforcing steel 60 within the beam mold 90. In FIGS. 6 & 8 the twist connector channel 225 is used with the dovetail joint 213 and the flange heads 225*b* as shown in FIG. 12A.

Figure 10:
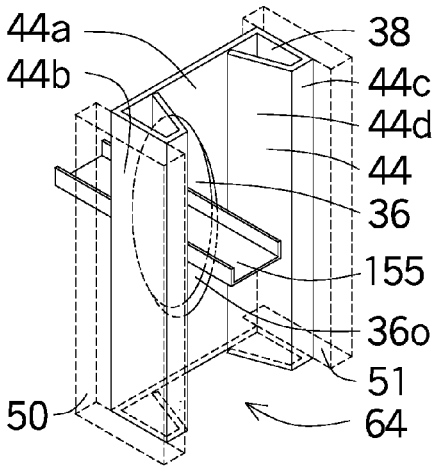
FIG. 10 shows an isometric view of the bent flange channel with a horizontal bracing channel.

FIG. 10 the connector is a bent flange channel 44 which is similar to the C channels 42 previously described. The bent flange channel 44 has a web 44*a*, a flange 44*b* that is perpendicular to the web 44*a*, a bent flange 44*d* being parallel to the web 44*a* with a hole in the web 44*a*. The bent flange channel 44 has a web 44*a* which is the same width as the spacer insulation 52. The bent flanges consist of two parts, the flange 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. The light gauge metal used in forming metal channels has limited strength. By using two double flanges 44*b* and 44*d*, the two surfaces increase the strength of the channel as well as increasing the strength of the connection with the fastener 37. FIG. 2 shows the bent flange channel 44 as a connector where the flanges 44*b* abut the rigid board 50 and the rigid insulation 51 and screws 122 as well as secured to the bent flange 44*d*. Additional finishes (not shown) can be installed into the bent flange channel 44 after concrete 39 has been installed into the column mold 20 by installing the screws 122 through the flange 44*a* into the cavity 38. FIG. 6 shows many different connectors including the bent flange channel 44 as a support channel and as a connector since the web 44*a* is part of the column mold 20 and the flange 44*b* and the return flange 44*c* are connected to the inner and outer boards and the spacer insulation 52 fits between the return flanges 44*c*. In addition, the bent flange channel 44 shows foam material 54 installed between the flange 44*b* and the inner and outer boards, as well as within the cavity 38.

Figure 11:
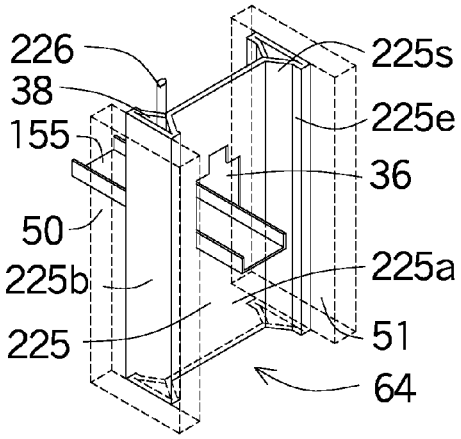
FIG. 11 shows an isometric view of the twist connector channel with a horizontal bracing channel.

FIG. 11 shows an isometric view of a connector 64 shown as twist connector channel 225 which has a web 225*a* with a hole 36 connected by flange heads 225*b* at both ends of the twist connector channel 225. The web 225*a* is shown with a hole 36 for a horizontal bracing channel shown as a horizontal U channel 155 to pass through. The flange heads 225*b* are connected to the rigid board 50 and the rigid insulation 51 by fasteners (not shown), while in FIG. 12A an enlarged view of the flange heads 225*b* are shown recessed into the V shape groove 64*a* of the rigid board 50. The flange heads 225*b* are V shaped where the vortex of the V is connected to the web 225*a*, and the sides of the V are two sloped sides 225*s* having two extending legs 225*e* and a back 225*w* which is the width of the flange heads 225*b*. Since the twist connector channel 225 has a web 225*a*, the twist connector channel 225 must be slid into the V shape groove 64*a* as shown in FIG. 12A. Shorter web sections or brackets of the twist connector channel 225 can be installed within the V shape groove 64*a* allowing different types of brackets to be used as connectors between the inner and outer boards.

FIG. 12A shows an enlarged plan view of a groove shown as V shape groove 64*a* where a connector can slid into. The twist connector channel 225 in FIG. 11 is shown in ghost in FIG. 12A and has a similar edge profile that can fit into the V shape groove 64*a*. The V shape groove 64*a* is recessed into rigid board 50 also shown in FIGS. 1, 6, 8 & 9. After the rigid board 50 or rigid insulation 51 are cut into slabs, the material needs to be cut or routed to form the V shape groove 64*a* into which the edge profile of the flange heads 225*b* of the twist connector channel 225 can be slid into the V shape groove 64*a* of the rigid board 50 or rigid insulation 51 as shown in FIG. 1. The V shape groove 64*a* should conform to the edge profile of the connector. In FIG. 11 the edge profile of the twist connector channel 225 are the flange heads 225*b*. When the twist connector channel 225 is installed within the V shape groove 64*a* the flange heads 225*b* create sufficient friction from being pulled from the V shape groove 64*a* within the inner and outer boards. The extended leg 64*c* of the V shape groove 64*a* is shown to add additional resistance and strength to the holding capacity of the connector 64. The flange heads 225*b* of the twist connector channel 225 in FIG. 11 and the connector shaft 220*b* of the twist connector 220 in FIGS. 12B & 12C can both use the same V shape groove 64*a*. The edge profile of the in FIGS. 4 & 5 the rigid foam block faces 88 & 88' can be interchanged with rigid board 50 or rigid insulation 51 or with the sides 212*a* of the beam mold 212. In addition, the connector 64 can be of rigid plastic as well as metal as described earlier. The twist connector channel 225 as described in FIG. 11 has a cavity 38 similar to the cavity 38 of the bent flange channel 44 in FIG. 10. The flange heads 225*b* are V shaped where the vortex of the V is connected to the web 225*a*, and the sides of the V are two sloped sides 225*s* having two extending legs 225*e* (the extending legs 225*e* shown on one side only) and a back 225*w* which is the width of the flange heads 225*b*.

Figure 12B:
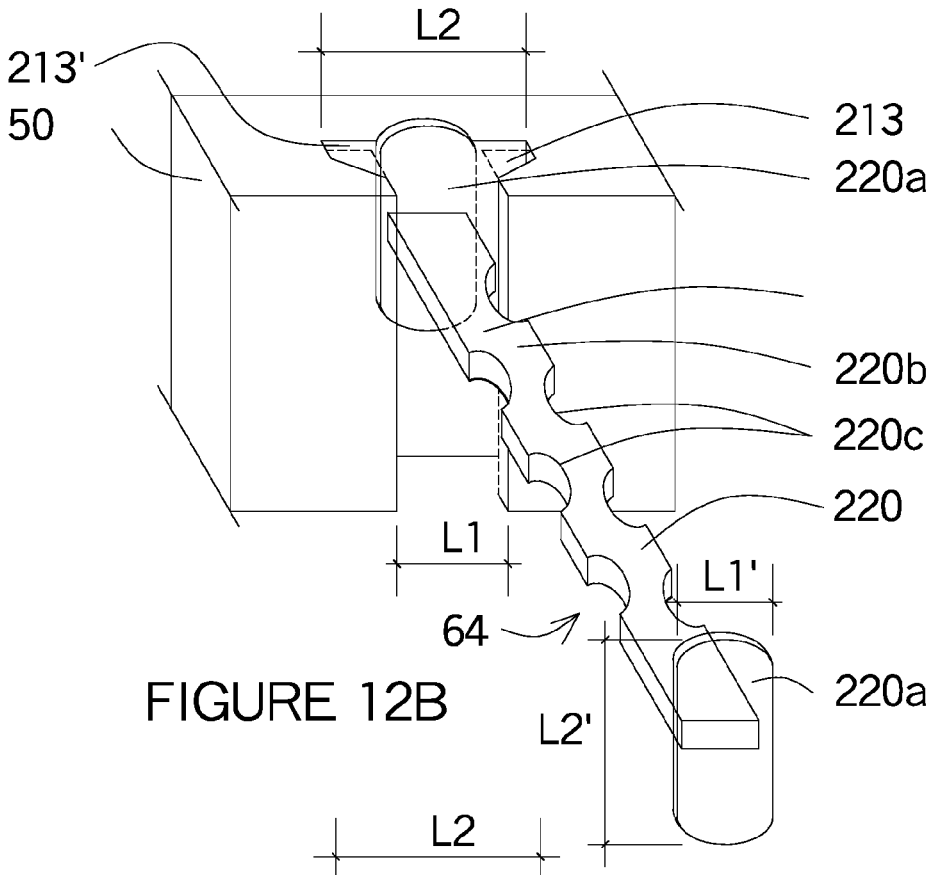
FIG. 12B shows an isometric view of a twist connector fitting into the dovetail slot prior to being twisted into place.
Figure 12C:
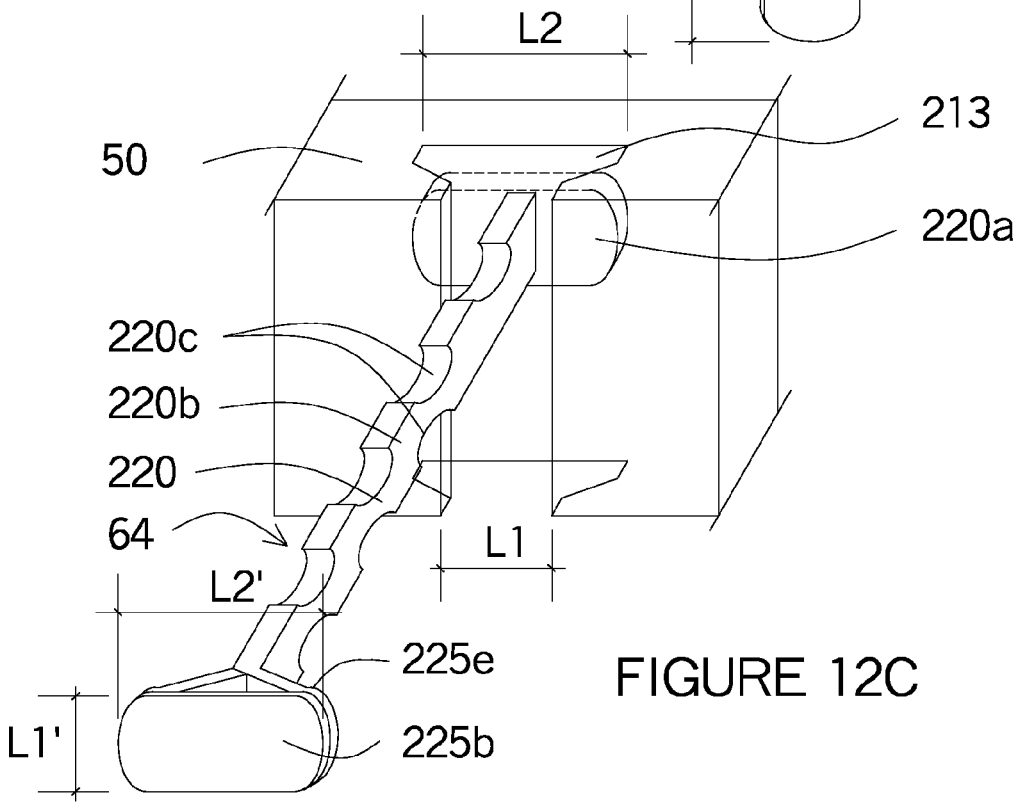
FIG. 12C shows an isometric of the twist connector where one side has a twist connector configuration and the opposite side having a plain end and locked into position of the dovetail groove.

The connectors 64 in FIGS. 12B and 12C show a twist connector 220 in an inserting position in FIG. 12B and the fixed position in FIG. 12C. As stated earlier the twist connector 220 is shown installed in the beam mold 90 in FIG. 9 in the one piece mold 212 and in FIG. 1 between the rigid board 50 and the rigid insulation 51 in the dovetail joint 213. In FIG. 12B the dovetail joint 213 has a wide opening at the interior side shown as L1 and a wider opening within the middle of the side wall 210*a* shown as L2. The twist connector 220 shown in FIGS. 12B & 12C has two connector heads 220*a* connected by a connector shaft 220*b*. The rectangular shaped connector heads 220*a* are shown having a narrow width L1' slightly larger than the connector shaft 220*b* and less than the opening L1 of the dove tail joint opening shown as L1. The length of the connector heads 220*a* shown as L2' fits into the width L2 of the dovetail joint 213. FIG. 12B shows the connector head 220*a* shown in a vertical position; where the smaller connector head L1' is inserted through the interior side L1 of the dovetail joint 213. The connector head 220*a* is then turned or twisted 90 degrees within the dovetail joint 213, so that the long length L2' of the twist connector 220 is turned the full width L2 of the dovetail joint 213. When the twist connector 220 is turned 90 degrees within the dovetail joint 213, the twist connector 220 is locked into position within the rigid board 50. The twist connector shaft 220*b* is rectilinear in shape and when the twist connector 220 is in the locked position, the twist connector shaft has a rebar depression 220*c* so steel reinforcing (not shown) can be installed in the rebar depressions 220*c* as shown in FIG. 9. In FIG. 12C one of the twist connector heads 220*a* is shown having the shape of the flange heads 225*b* with the flange head extension 225*e* as shown in FIGS. 11 & 12A.

Figure 13:
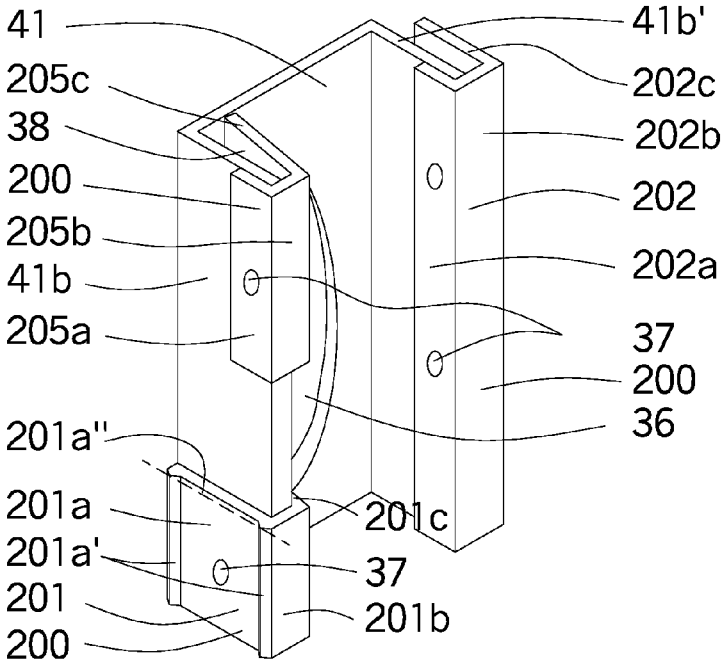
FIG. 13 shows an isometric view of a U channel with various flange extensions added to the channel.
Figure 14:
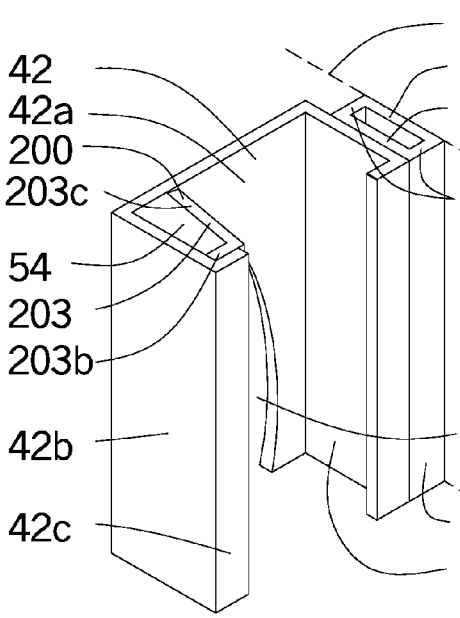
FIG. 14 shows an isometric view of a C channel with various flange extensions added to the channel.
Figure 15:
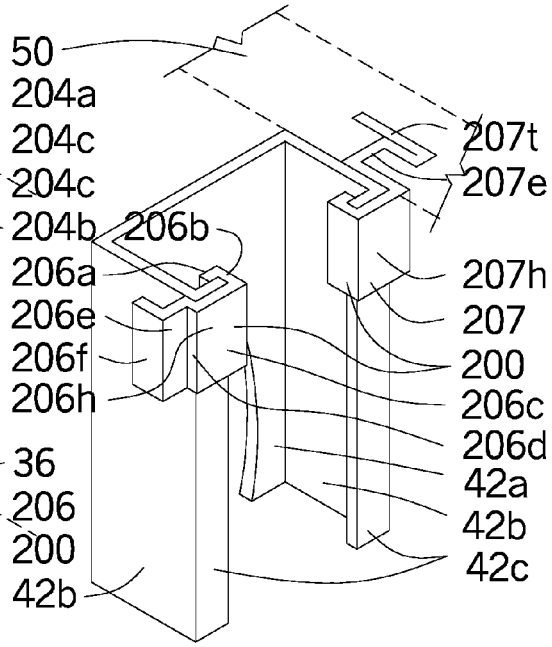
FIG. 15 shows a various snap-in-place configurations of flange extensions.

FIGS. 13, 14 & 15 shows various types of connectors, but are referred to as flange extensions 200 since the extensions are added to the end of the connectors 64. The flange extensions 200 are different configurations that are added to the U channel 41 and/or C channel 42 that changed the shape of the flanges 41*b* or 42*b* of the U channel 41 or C channel 42. The bent flange channel 44 in FIG. 10 shows a flange variation 205 in FIG. 13 where the flange variation 205 is shown attached to the U channel 41 at 205*a*, then bent at 205*b* around the flange 41*b* of the U channel 41 and continues at an angle shown at 205*c* to the web 41*a* forming a cavity 38. The flange variation 205 is full height of the connectors 64 since the cavity 38 is meant to allow fasteners (not shown) to be connected to the U channel 41, through the flange variation 205 and into the cavity 38. Another flange extension 200 shows the flange variation 201 being added to the flange 41*b* by creating a depression 201*a* to the sides of the flange 41*b*. The flange variation 201 is wrapped at the interior of the flange 41*b*, and then turned 90 degrees at 201*b* and again forming 201*a*. The side 201 shows a depression 201*a*" between two protruding elements 201*a*'. When a hard board 40 is installed over the depression 201*a* a cavity 38 is formed limiting the amount of thermal conductivity passing through the U channel 41. The flange extension 200 shows the flange variation 202 attached to the U channel 41 at 202*a*, then bent at 202*b* around the flange 41*b*, however a cavity 38 is formed between the flange 41*b* and the continuation of the flange variation 202 at 202*c*. The cavity 38 is formed so as to install a foam spacer 55 not shown between the flange 41*b* and the side 202*c*.

FIG. 14 shows a another flange extension 200 where the flange variation 203 also appears like the bent flange channel 44 in FIG. 10 except the flange variation 203 is installed by friction rather than a fastener 37 as shown in FIG. 13. The flange variation 203 has one leg 203*a* that rests against the lip 42*c* and the other leg 203*b* rests against the web 42*a* of the C channel 42. The leg 203*b* is at an angle to the web 42*b* similar to the flange variation 205. When the leg 203*b* fits against the lip 42*c* and other leg 203*c* rests against the web 42*a*, friction against the leg 203*b* to the web 42*b* holds the loose flange variation 203 in place. The flange extension 200 is also shown as a flange variation 204 which is rectangular tubular shape having sides 204*a*, 204*b* & 204*c*. The flange variation 204 can also be "C" using sides 204*a* and two sides 204*b* forming the "C" shape. By forming the rectangular tubular shape and the "C" shape a cavity 38 is formed so not to allow concrete (not shown) to flow into the cavity 38 of the column molds 20 and beam molds 90 shown in the previous figures.

FIG. 15 shows two additional flange extensions 200 shown as flange variation 206 & 207 attached to a C channel 42. The flange variation 206 wraps around the lip 42*c* of the C channel 42 forming a hook shape 206*h* shown as 206*a*, 206*b*, 206*c* & 206*d*. The hook shape 206*h* start at 206*a* at the inside of the lip 42*c*, then wraps around the lip 42*c* at 206*b*, then extends the full length of the lip 42*c*, then turns again 90 degrees onto the flange 42*b*. By wrapping the hook shape 206*h* around the lip 42*c* and making the 90 degree turn onto the flange 42*b*, the hook snaps into place. The end of the flange variation 206 turns 90 degrees away for the flange 42*b* at 206*e* and turns 90 degrees similar to flange variation 202. The flange variation 207 has the same hook shape 207*h* as does 206*h*. The end of the hook shape 207*h* the flange variation 207 turns 90 degrees shown as 207*e* then forms a "T" shape 207*t* at the end similar to the end of an H channel 40 shown in FIG. 3.

Figure 24:
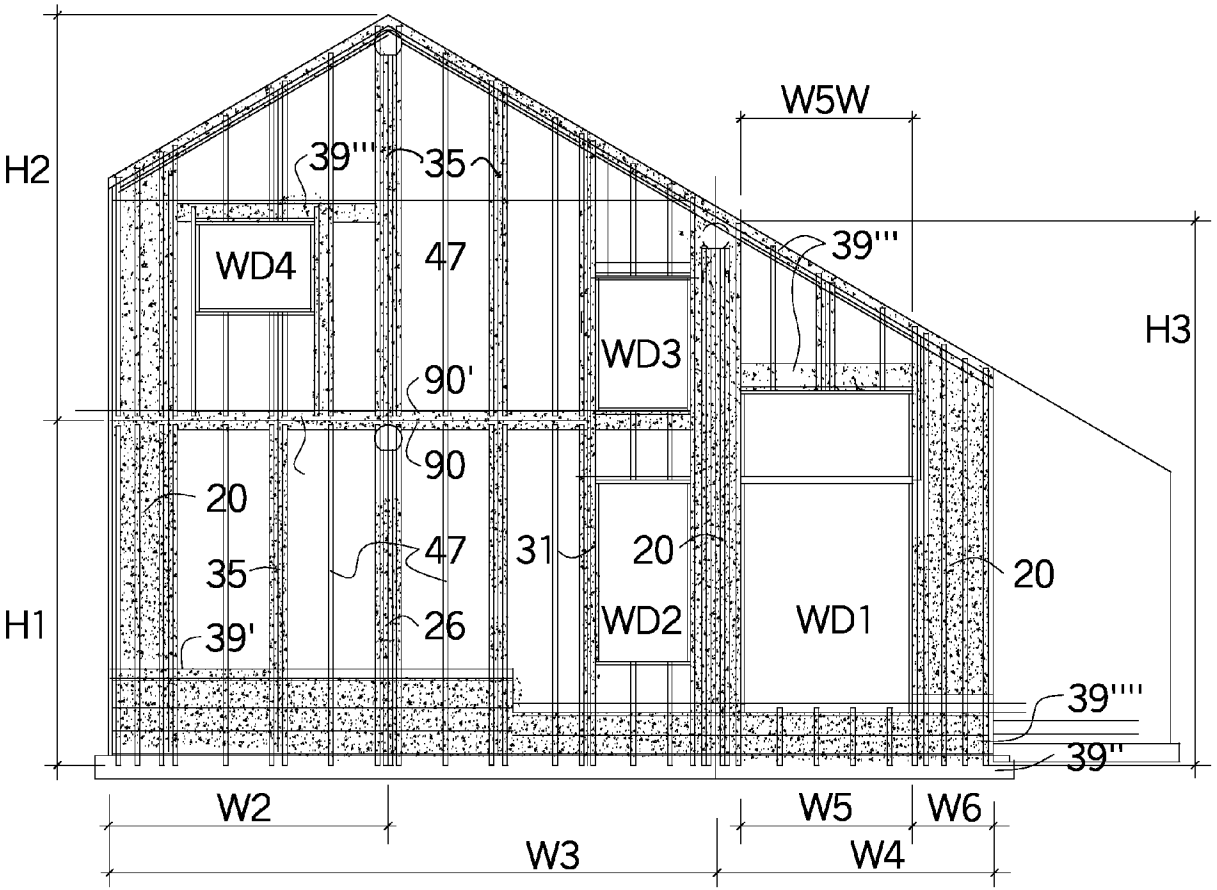
FIG. 24 shows the wall forming structure for a building where and enlarged column is used to support a beam, an L shaped column at the end of the wall and how the column at a window is incorporating within the building molds.

The flange extensions 200 shown a flange variations 201-207 can be short brackets or full length depending on the height of the wall as shown in FIG. 24 and can be manufactured of plastic or metal. The flange extensions 200 are attached to the U channel 41 or C channels 42 when embedded into any of the previous described concrete molds in order to have a cavity 38 into which drywall (not shown) can be installed into the concrete molds.

Figure 16:
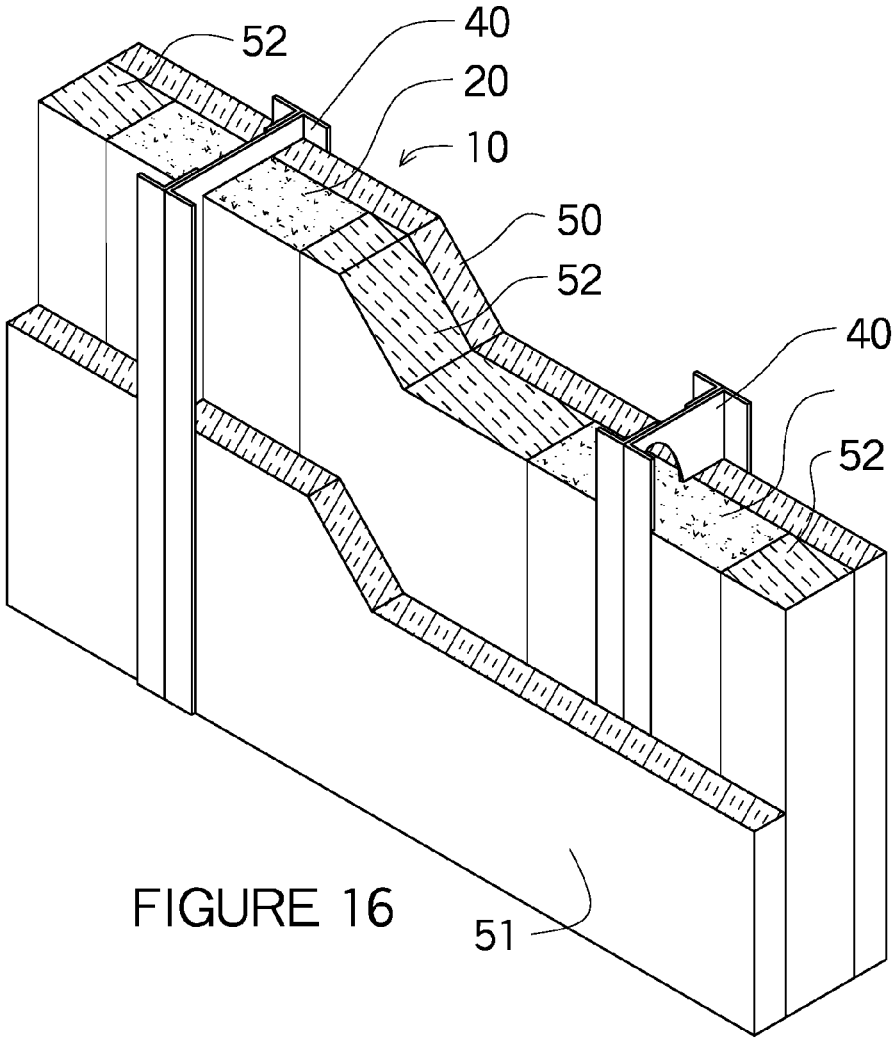
FIG. 16 is an isometric view of a column in a building wall using a wall mold structure in the middle of the column.
Figure 17:
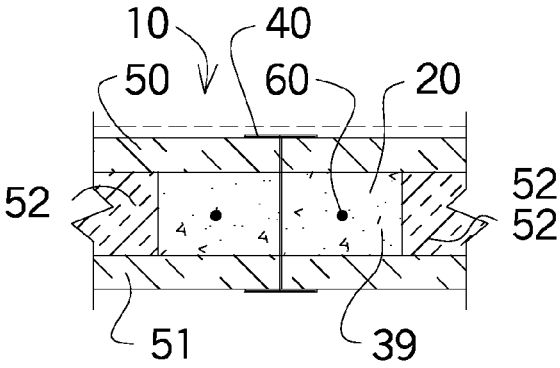
FIG. 17 shows a plan view of a column within the building wall straddling the wall forming mold.
Figure 18:
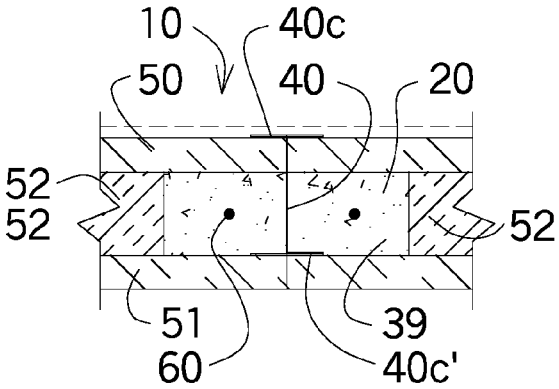
FIG. 18 shows a plan view of a column within the building wall partially embedded with the wall forming mold.

In FIG. 16 a wall mold 10 is shown in isometric view with two different configurations of column molds 20. The wall mold 10 consists of a rigid board 50 and rigid insulation 51 or the inner and outer rigid boards that define the outer surfaces of the wall mold 10. The interior of the column molds 20 are also shown in a plan view drawing in FIG. 17 and FIG. 18. The width of the column mold 20 are determined by the thickness of the spacer insulation 52 located between the rigid board 50 and the rigid insulation 51. On the other hand, the width of the column molds 20 is the distance between the spacer insulation 52. In FIG. 17 the support channel of the column forming structure is an H channel 40 shown at the middle of the column mold 20 extending outside of the wall mold 10 but yet an integral part of the column mold 20 securing both the rigid board 50 and the rigid insulation 51 to the wall mold 10. In FIG. 18 the H channel 40 is smaller than in FIG. 17 which allows the rigid insulation 51 to be secured to the outer surface of flange 40*c* of the H channel 40. The opposite flange 40*c*' of H channel 40 is secured on the interior surface of the flange 40*c*' making it easier to fasten another material to the H channel 40. Since no fastening means is shown connecting the spacer insulation 52 to either the rigid board 50 and rigid insulation 51, the material has to be compatible so an adhesive (no shown) can connect the various materials together. The depth of the column molds 20 are determined by the structural strength of the adhesive and the bending stress of the rigid board 50 and rigid insulation 51. On the other hand, the rigid board 50, rigid insulation 51 and the spacer insulation 52 could all be formed of the same material and secured together with the H channel 40. Steel reinforcing 60 can be added prior to the column molds 20 being filled with a hardenable material.

Figure 19:
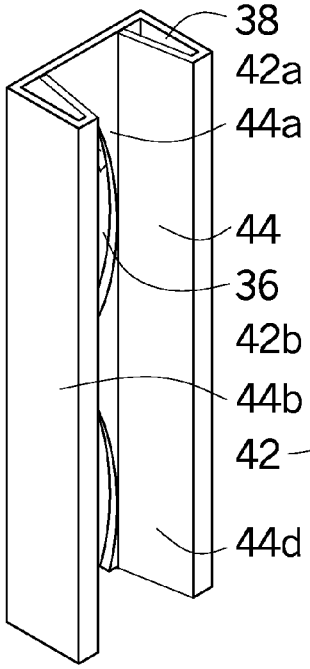
FIG. 19 is an isometric view of the bent flange channel.
Figure 20:
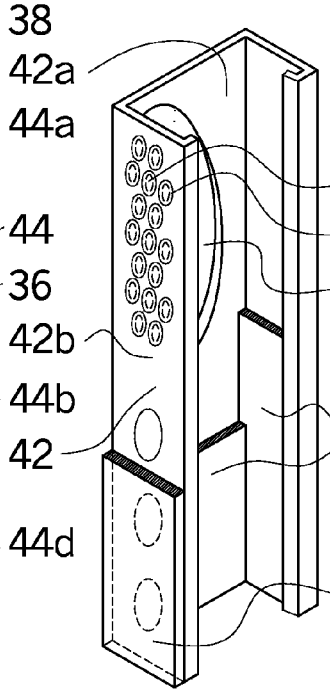
FIG. 20 is an isometric view of a forming structure showing the foam material attached to the interior flange of the forming structure.
Figure 21:
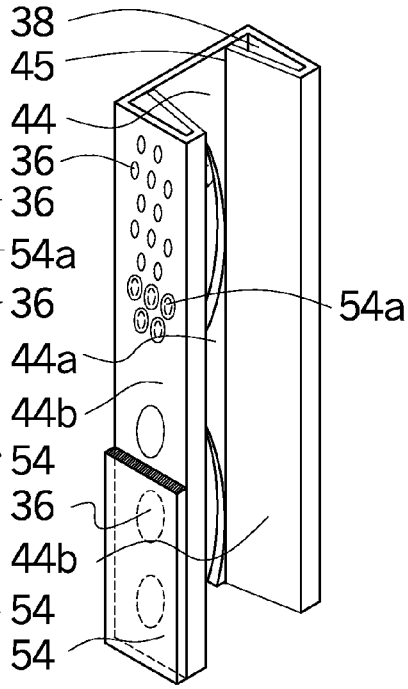
FIG. 21 is an isometric view of a bent flange channel with holes for use as part of the wall forming structure.
Figure 23:
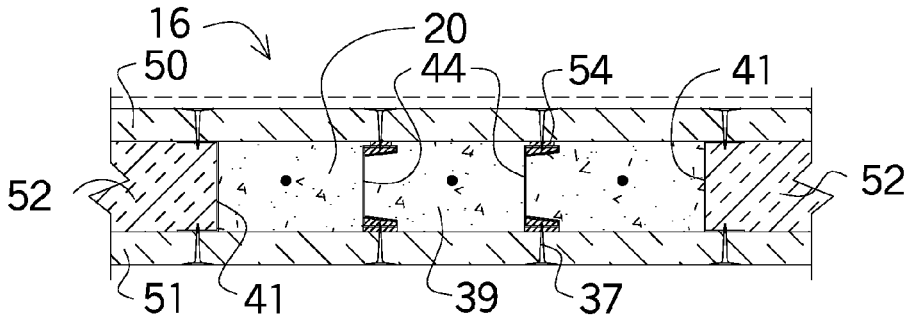
FIG. 23 is a plan view of an elongated column forming structure using two intermediate forming structures with insulation at the outer surface and interior of the flanges.

FIGS. 19-21 are isometric views of several forming structures previously described. FIG. 19 shows an enlarged view of the bent flange channel 44 previously shown in FIGS. 2, 6 & 10 however this isometric view shows holes 36 in the web 44*a*. In FIG. 21 is the same bent flange channel 44 in FIG. 19, except the flange 44*b* also has holes 36. The holes 36 in the 44*b* flange are used to install foam material 54 into the holes 36 filling the cavity 38 and covering the flange 44*b* with foam material 54. If the foam material 54 is installed in a factory, the foam material 54 will first fill the cavity 38 and then the residual is then removed with a hot knife (not shown) to form a smooth plane parallel to the flange 44*b*. If the foam material 54 is installed at the construction site, the foam material 54 will be soft and when either the rigid board 50 or rigid insulation 51 is secured with fastener 37, the foam material 54 will be of sufficient thickness to separate the rigid board 50 or rigid insulation 51 from the bent flange channel 44 as shown in FIG. 23. Another way to install the foam material 54 is through the gap 45 between the web 44*a* and the bent flange 44*d*. When installing the foam material 54 through the gap 45, located between the bent flange 44*d* and the web 44*a*, the foam material 54 will first fill up the cavity 38 and then the excess will penetrate through the holes 36. Depending when the foam material 54 is applied, the foam material 54 excess will be cut (by a hot knife not shown) to form as smooth plane parallel to the flange 44*b*. FIG. 20 shows the same holes 36 at the flange 42*b* of the C channel 42. The holes 36 are shown with the foam material 54 passing through the holes 36. Depending on the amount of foam material 54 that has been installed through the holes 36, the foam material 54 shown on the flange 42*b* or 44*b* will form a bell shape 54*a* or the foam material 54 when smoothed will form a solid rectangular shape 54*b*. In FIG. 20 the foam material 54 is shown on the web 42*a* which is typically used around windows and doors for securing them to the web of the column forming structure like 42*a*.

Figure 22:
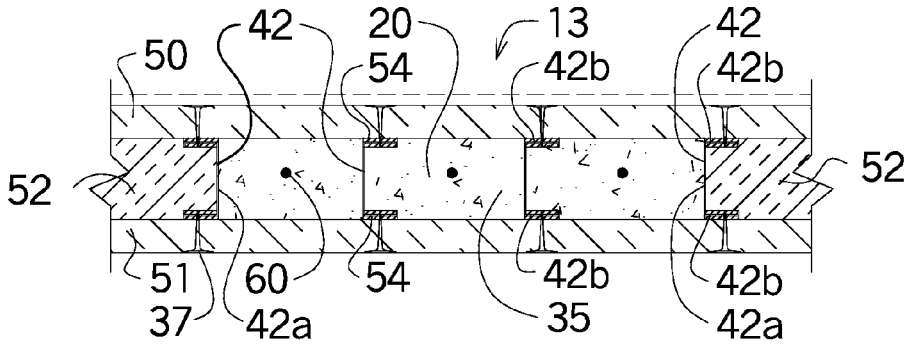
FIG. 22 is a plan view of an elongated column forming structure using two intermediate forming structures.

The FIGS. 22-23 shows the wall molds 13 & 16 which consists of a rigid board 50 and rigid insulation 51 as the outer surfaces of the wall molds 13 & 16 along with the spacer insulation 52 between the outer surfaces. In FIG. 22 the column forming structure shown in column mold 20 consists of four support channels shown in FIG. 20. For clarity purposes, the two C channels 42 that are located in the middle of the column mold 20 are shown with the foam material 54 at the flanges 24*b* as shown in FIG. 20. The two C channels 24 shown at the spacer insulation 52 are also shown with the foam material 54*b*; however the foam material 54 can be eliminated if the spacer insulation 52 is cut slightly differently. The distance between the two webs 42*b* of the C channel 42 that encase the spacer insulation 52 is the total width of the column mold 20. The depth of column mold 20 is the distance between the outside surfaces of the foam material 54 of both flanges 42*b* more clearly shown in FIG. 20. The number of C channels 42 will vary depending size and structural requirements of the concrete column 35 and the steel reinforcing 60 required. FIG. 23 is similar to FIG. 22, except here the column forming structure consists of two support channels shown as bent flange channels 44 in the middle of the column mold 20 and two U channels 41 shown at the ends of column mold 20. Like in FIG. 22, the foam material 54 is adjacent to the bent flange channel 44 as well as the rigid board 50 and the rigid insulation 51. Any additional material (shown in ghost) may be attached with fasteners 37 after the concrete 39 has cured in either the column molds 20 because both the C channel 42 and the bent flange channel 44 have foam material 54 behind the flanges 42*b* & 44*b* of their respective channels.

FIG. 24 shows a panel diagram of a building elevation using many of the previously described column and beam molds as well as the wall panels. When constructing a building using wall panels, each wall panel requires a different number even though the wall panels are a variation of the previously described wall panels 65. The wall panels shown in this drawing can be as narrow as 4'-0" wide shown as W1 to intermediate panel widths shown as W2 to full width walls shown as W3. The height H1 of any of the W1, W2 or W3 wall panels could be from the footing 39", including the concrete foundation 39"" to the beam mold 90 at the second floor. Wall panels are sometimes manufactured from column centerlines or from large window jambs depending on the size of the windows. The wall panel W4 is shown in the middle of column mold 20 to the end of the wall mold 32 and extending from the footing 39", including the foundation 39''' to the roof referring to height H3. On the other hand, smaller sections like a foundation wall panel W5 is easier to handle without using a crane (not shown) to install the foundation wall panel W5. Another example would be wall panel W6 as part of an L column mold 20 or a window header mold W5W which incorporated a concrete beam 39''' at the roof line as well as above the door/window WD1. The interlocking panel connection shown in FIGS. 1 & 2 is shown at the beam molds 90. On the other hand, the wall panel W2 could be two stories high by making the panel heights H1 and H2 as all one panel height. This particular building showed the concrete columns 35 close together, therefore there are not many spacer channels 47. The column mold 20 is shown wider as it depends on the spacing between window/door WD1 & WD2 as well as any floor or roof beams that would affect the size of the column mold 20. For example, the column mold 20 is shown in FIG. 20 as an L shape is used on the right side of the building along with the window detail shown in the same drawing. Another column mold 20 is shown on the left corner of the building that is also L shaped, however the size and number of column support members is less than on the right side. A column mold 20 is shown next to a window WD2 and is a wider column mold. Since a concrete beam 39''' is located between the building floors above, a window header like a concrete beam 39''' is not required.

Figure 25:
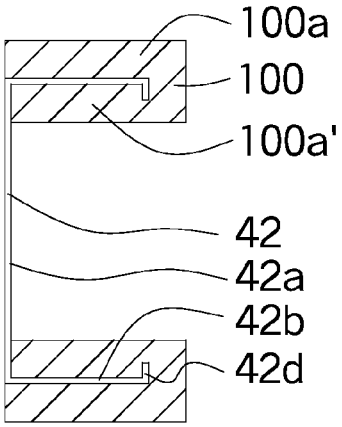
FIG. 25 shows a C channel with the foam material wrapped around the flange of the C channel.
Figure 26:
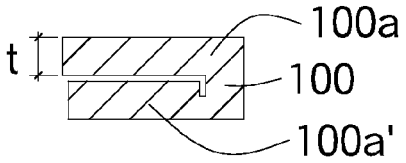
FIG. 26 shows the foam material configuration for the C channel.

In FIG. 25 shows a cross section of a C channel 42 with a different insulating foam 100 wrapped around the flange 42*b* of the C channel 42, and shown in FIGS. 19 & 20 as well as in some of the previous wall mold applications. The insulating foam 100 has a thickness t which is constant as it wraps around the flange 42*b*. The C channel 42 also has a lip 42*c* at the end of the flange 42*b*. The insulating foam 100 extends the length of the flange 42*b* shown as 100*a*, then around the lip 42*c* over the back side of the flange 42*b* shown as 100*a*' and stops at the web 42*a*. The lip 42*c* and the friction of the flange 42*b* allows the insulating foam 100 to adhere to the C channel 42. The insulating foam 100 is shown in FIG. 26 after a hot knife (not shown) has cut the groove into the insulating foam 100 for the C channel 42 configuration.

Figure 28:
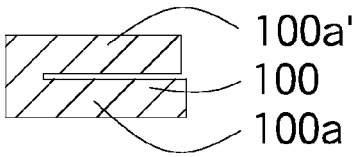
FIG. 28 shows the foam material configuration of the double flange channel.
Figure 27:
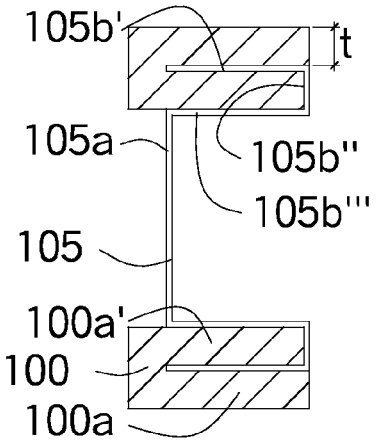
FIG. 27 shows a double flange channel with the foam material inserted into the double flange channel
Figure 29:
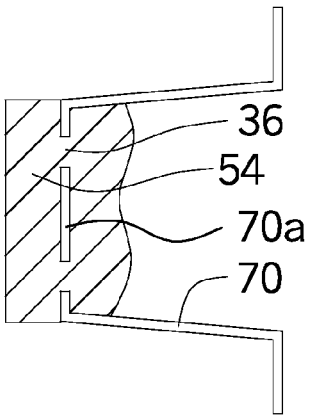
FIG. 29 shows the foam material on both sides of the hat channel.
Figure 34:
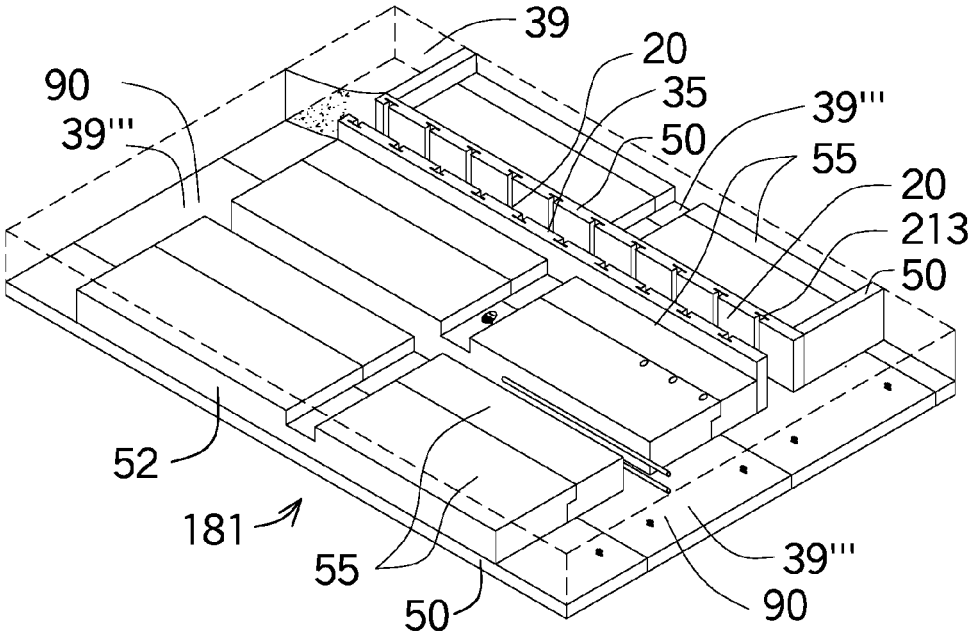
FIG. 34 is an isometric of a precast wall when the concrete is poured over the structural insulating core.

FIG. 27 shows a double flange channel 105, which is another type of support channel to form column molds 20 and beam molds 90 that consist of a web 105*a* and two bent flanges 105*b*' & 105*b*''', one at each end of the web 105*a*. The bent flanges show an outer flange 105*b*', a turning flange 105*b*'', and a returning flange 105*b*'''; which are connected to the web 105*a* of the bent channel 105. The bent flanges allows a fastener (not shown) to be connected to two flanges, the outer flange 105*b*' and the inner flange 105*b*'''. These double flanges 105*b*' & 105*b*''' gives the fastener 37 (not shown) twice the strength to support the rigid board 50 or rigid insulation 51 from the pressure of the concrete 39 shown in any of the previously mention Figures. Also shown in FIG. 34 is insulating foam 100 that is wrapped around the bent flange 105*b*. The insulating foam 100 extends the length of the flange 105*b*''' shown as 100*a*, then around the turning flange 105'' over the back side of the returning flange 105*b*''' shown as 100*a*' and stops at the web 105*a*. The friction between the outer flange 105*b*' and the returning flange 105*b*''' is sufficient to hold the insulating foam 100 into place. The insulating foam 100 as shown in FIG. 28 can also be used on U channels or on H channels previously described.

Figure 30:
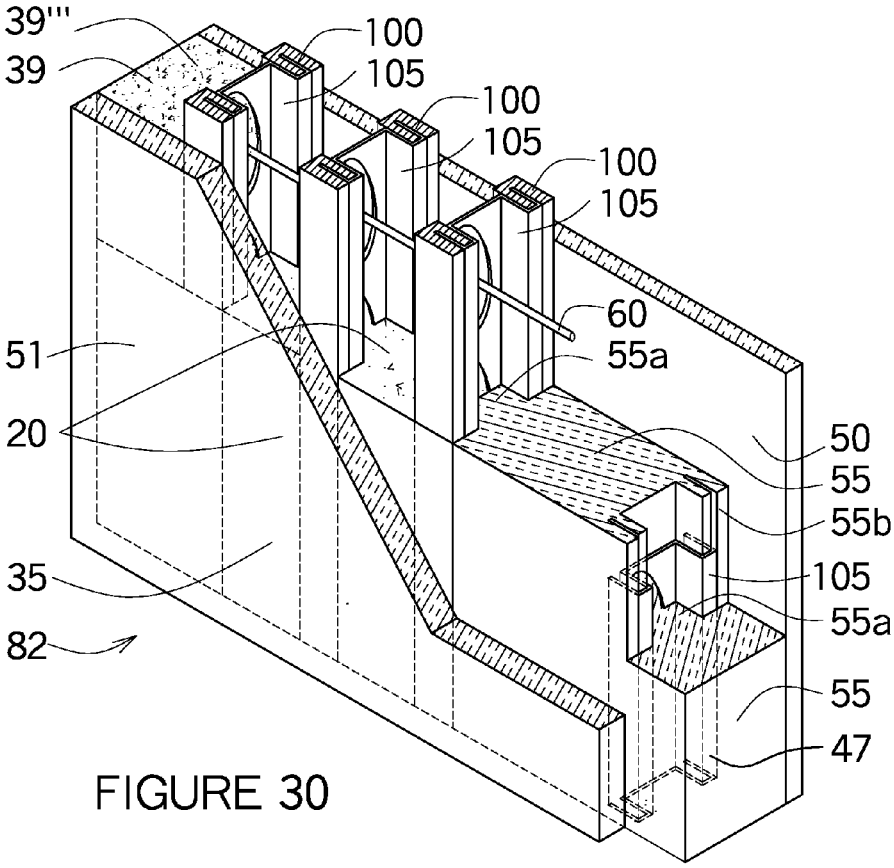
FIG. 30 shows an isometric drawing of the double flange channel with the column and beam in wall.
Figure 31:
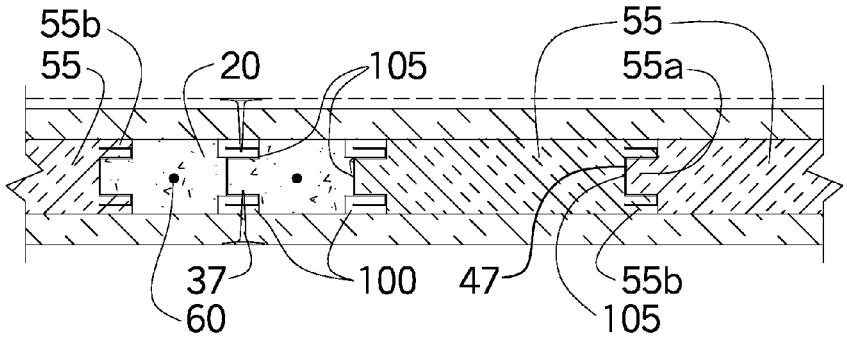
FIG. 31 shows a plan view of the double flange channel in the wall.
Figure 38:
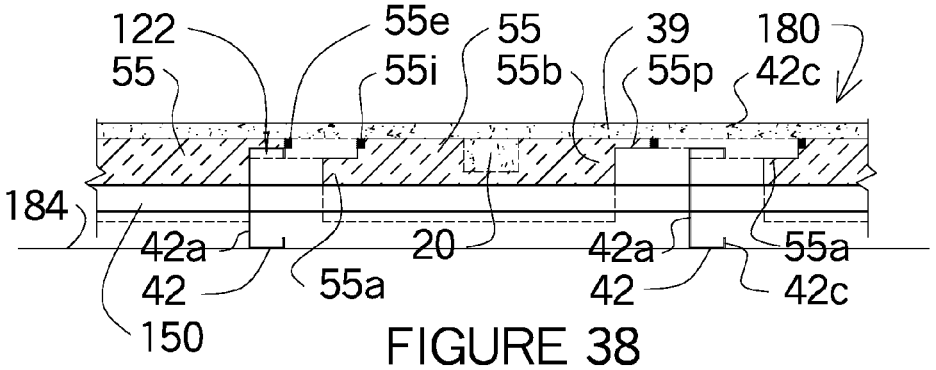
FIG. 38 is a wall section view of FIG. 2 with the concrete poured over the structural insulating core.

FIGS. 30 & 31 is a structural insulating core that consists of foam spacers 55 and support channels within the foam spacers 55 with rigid board 50 and rigid insulation 51 installed over the structural insulating core. The foam spacers 55 wrap around the flanges 105*b*' & 105*b*''' of the support channels and the webs 105*a* interlock between adjacent foam spacers 55. In addition, the flanges 105*b*' of the support channels fit into grooves shape 55*b* of foam spacer 55 and where the support channels are located within a column mold 20 or the spacer channels 47 within the foam spacers 55. More specifically the support channel of the column mold 20 forming structure is a double flange channel 105 and the interconnection between the foam spacers 55 and the insulating foam 100. FIG. 31 is showing the wall mold 81 consisting of the rigid board 50 and the rigid insulation 51 as the outer surfaces of wall mold 81. The structural insulating core forming structure at the column mold 20 consists of three double flange channels 105, however only one double flange channel 105 on the right side of the column mold 20 has the insulating foam 100. The insulating foam 100 is wrapped around the flange 105*b*' of the double flange channel 105 and the isometric shows the insulating foam 100 is also attached to the double flange channel 105 above the foam spacers 55. The foam spacer 55 is configured to have a tongue shape shown as 55*a* and a groove shape shown as 55*b*. The tongue shape 55*a* extends to the web 105*a* of the double flange channel 105 and has a depth of the inner flange 105*b*'''. The width of the foam spacer 55 extends from the outer edge of the insulating foam 100 on both sides of the double flange channel 105. The other side of the foam spacer 55 shows a double flange channel 105 between the foam spacers 55. The foam spacer 55 is shown abutting the double flange channel 105 and shown as 55*b* as the groove side of the foam spacer 55. The foam spacer 55 fits adjacent to the web 105*a* of the double flange channel 105 and extends to the turning flange 105*b*'' to the edge of the projection 55*p* of the adjoining foam spacer 55. The groove shape 55*b* is configured so that the outer flange 105*b*' fits into a slot 55*s* within the projection 55*p* of the foam spacer 55. The adjacent foam spacer 55 is shown with the tongue shape 55*a* fitting securely against the web 105*a* of the double flange channel 105. Where the column mold 20 occurs, the insulating foam 100 is required the full height of a concrete column 35. On the other hand, where foam spacer 55 is required at the opposite end of the column mold 20, a groove shape 55*b* is required to begin an array of foam spacer 55 and double flange channels 105 within the wall mold 81. In FIG. 38 the double flange channel 105 being used as an spacer channel 47 similarly to the C channels shown on the right side of FIGS. 1 & 2. The combination of the double flange channel 105 and the foam spacer 55 is another combination of the structural insulating core 111. The column molds 20 (only one shown) and beam mold 90 can be any size depending on the structural requirements of the column and beam. The wall mold 82 can consist of several wall panels 65 between each column mold 20 and the beam mold 90 within the wall panels 65 connects to the column molds 20. Where a beam mold 90 occurs, the insulating foam 100 is installed on the double flange channel 105.

Figure 32:
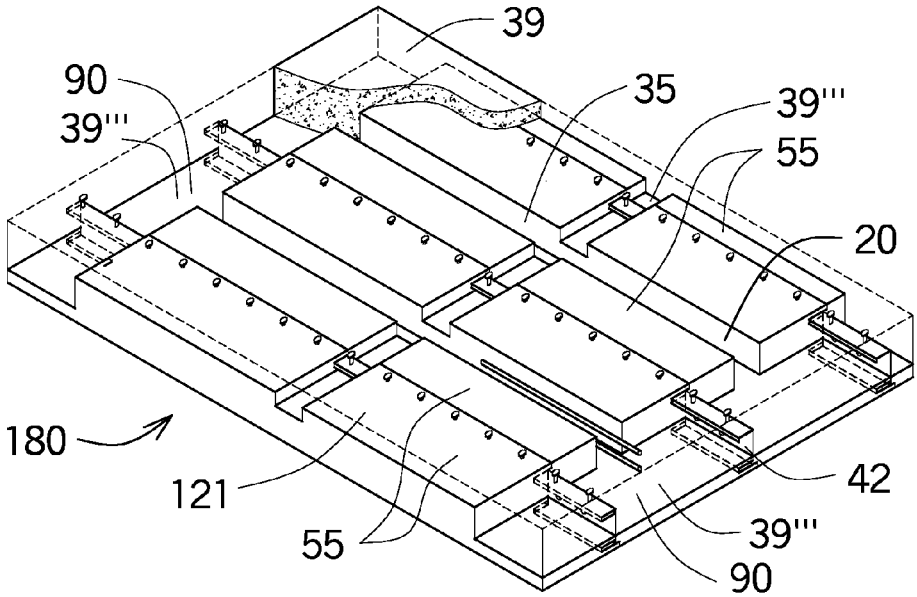
FIG. 32 shows a isometric view of precast wall mold when the concrete is poured over the structural insulating core where the metal channel is located between the concrete columns.
Figure 33:
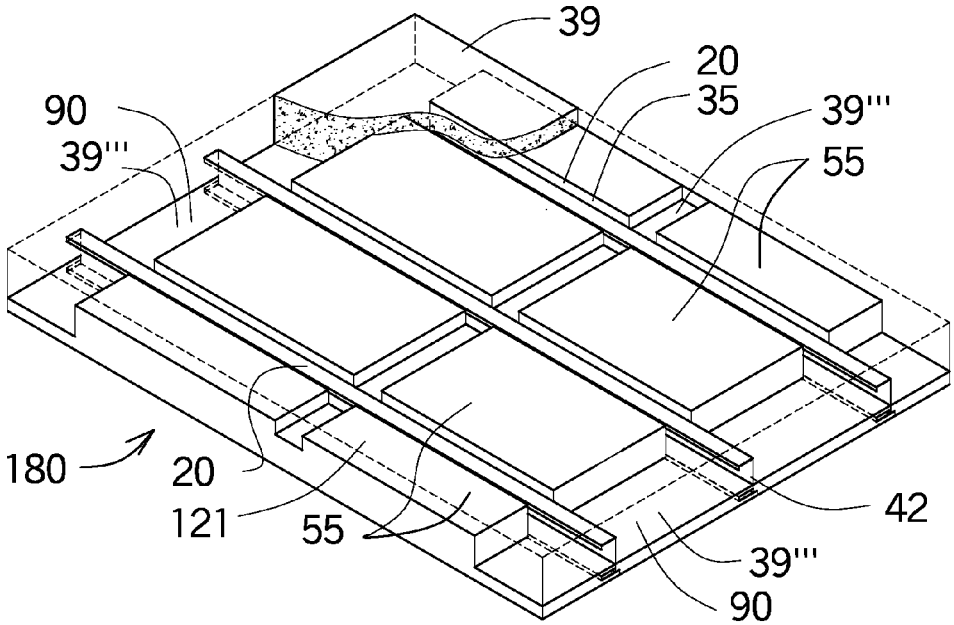
FIG. 33 shows a isometric view of precast wall mold when the concrete is poured over the structural insulating core where the metal channel is located at the concrete columns.

FIGS. 32 & 33 show similar isometric views of the concrete columns 20 and the concrete beams 90, however the structural insulating core of C channel 42 and the foam spacers 55 are arranged differently; however still forming a similar precast mold 180 where the concrete 39 is poured on top of the structural insulating core. The foam spacers 55 are connected between each of the C channels 42 forming the structural insulating core. Concrete columns 20 or concrete beams 90 can be formed anywhere within the precast mold 180 by removing the foam spacer 55 at a column mold 20 or beam mold 90 location. The column mold 20 in FIG. 32 is shown in the middle of the foam spacer 55 while the column mold 20 in FIG. 33 is formed between foam spacers 55. One half of the column mold 20 is formed at one foam spacer 55 and the other half is formed at the adjacent foam spacer 55. The foam spacer 55 overlaps the C channel 42 and interlocks with the adjacent foam spacer 55. When the spacer insulations 55 are connected together the column mold 20 is formed with the C channel 42 located in the middle of the column mold 20. When the concrete 39 is installed over the foam spacer, the foam spacer 55 remains attached to the C channels 42 and become a part of the precast mold 180.

Figure 36:
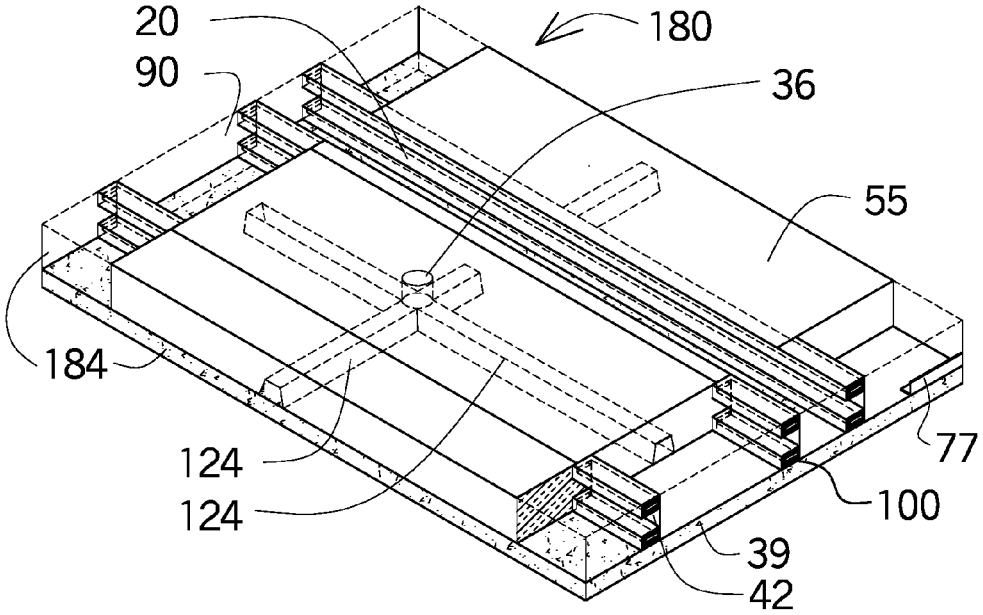
FIG. 36 shows an isometric view of a concrete mold where the concrete is below the structural insulating core.
Figure 37:
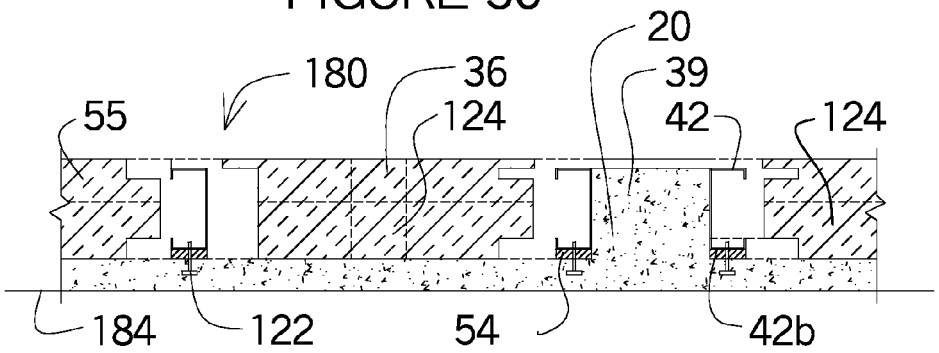
FIG. 37 shows a wall section of the concrete mold shown in FIG. 5.

The precast mold 180 in both FIGS. 32 & 33 can be turned upside down as shown in FIGS. 36 & 37 using holes 36 that can be installed in the foam spacer 55 in order to place concrete 39 within the precast mold 180.

Figure 35:
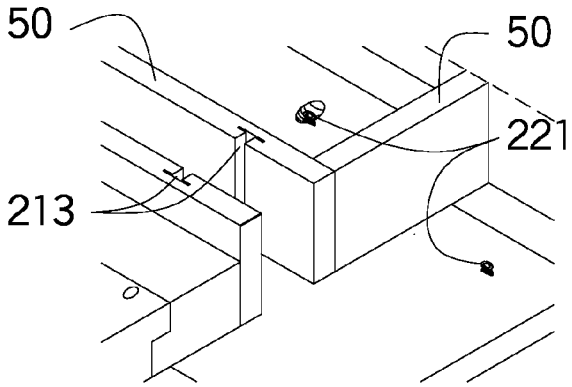
FIG. 35 is an enlargement of the column and beam where a filler is used to form a deeper column and beam mold.

FIG. 34 is similar to FIG. 32 except the C channels 42 in the structural insulating core have been removed. The spacer insulation 52 used in FIG. 34 is an aerated autoclave concrete which is manufactured differently and is harder than polystyrene. Both materials are considered a insulating type product, however autoclave concrete is harder and can be exposed to the exterior when protected from the weather by painting. Aerated autoclave concrete can be manufactured in different densities and therefore the exterior surface or rigid board 50 is a denser aerated autoclave concrete and spacer insulation 52 is more porous and has a greater insulating value or the entire wall mold 181 can be the foam spacer 55 which is the denser insulation. Column molds 20 can be formed in various ways as shown in FIGS. 32 & 33; however in FIG. 34 the rigid board 50 extends above the spacer insulation 52 allowing the column mold 20 to be deeper than the spacer insulation 52 of the wall mold 181. The connector in FIG. 8 or the twist connector 220 in FIG. 9 can be used to support the rigid board 50 on both sides of the column mold 20. A T shaped joint 213, shown in ghost in FIG. 12B, is also shown in FIGS. 34 & 35. Since aerated autoclave concrete is soft prior to being installed in an autoclave at the manufacturing plant, the lift connector 221 can be embedded into the aerated concrete prior to autoclaving and the connector and a depression 221*d* can also be installed in the wet aerated concrete. After the aerated concrete has been autoclaved, it is harden and the panels can be moved using the lift connector 221. In addition, the connectors (not shown) can be used to hold the aerated autoclaved concrete or the foam spacer 55 to the concrete 39 within the column molds 20 or the beam molds 90. The spacer insulations 52 and rigid board 50 can be glued together or can be screwed together depending on the densities if the spacer insulations 52.

FIG. 36 shows an isometric view of precast mold 180 except the precast mold 180 is shown face down and FIG. 37 is the wall section of FIG. 36. The precast mold 180 is turned upside down so that the precast mold 180 is now placed onto a forming bed 184 and the structural insulating core is suspended over the forming bed 184 so the flange 42*b* is set to the depth of the concrete 39 of the precast mold 180. In FIGS. 13-15 show the foam material 54 that can be used for C channels 42 or U channels 41. The foam material 54 is not necessary unless an additional material is going to be attached to the concrete 39. Holes 36 are cut into the structural insulating core at the criss-crossing ribs 124 to ensure concrete 39 flows into the ribs 124. Another way to form the precast mold 180 is to install the insulating foam 100 on each of the C channels 42 along with the screws 122 and install an angle 77 connecting each C channel 42 to the desire shape of the precast mold 180. Now set the precast mold 180 over the forming bed 184 and pour the concrete 39 into the forming bed 184, beam mold 90 and into the column mold 20. After the concrete has become firm, then add the remaining foam spacer 55 to complete the structural insulating core. The edge forming boards of the precast mold 180 are shown in (ghost).

FIG. 38 shows the support channels as C channels 42 that are placed horizontally on the floor 175 or a forming bed (not shown). The precast mold 180 is above the C channels 42 since the projection 55*p* rest on the flange 42*b* of the C channels 42 and the remainder of the foam spacers 55 rest on the horizontal bracing channel shown as a U channel 155 spanning between the support channels. The beam mold 90, column mold 20 or any ribs 124 (not shown) are on the same surface as the projection 55*p* and the screws 122 are attached through the projection 55*p* of the foam spacer. The concrete mold 180 is complete when steel reinforcing 60 (not shown) and concrete can then be installed over the precast mold 180. After the concrete 39 has cured, the concrete mold 90 can be tilted vertically into place. On the other hand, the precast mold 180 as described above can be assemble in place or as a precast mold and hoisted into place to become a floor 175 rather than a precast wall. Depending on the insulation requirements, the foam spacers 55 can be deeper as shown dotted in FIG. 38.

CONCLUSION AND SCOPE OF INVENTION

The present invention is a wall mold system using connectors between inner and outer rigid boards to form concrete beams and columns and a structural insulating core wall of structural supports between spacer blocks or insulation spacers to form beam and columns molds using the wall as a mold. The spacer insulation and/or spacer blocks interlock between each other and between the support members with its inner and outer boards also interlocking between each other. The sides of the structural insulating cores are used to form the column and beam molds along with the various types of connectors used to connect the column and beam molds together so concrete can be poured into the molds when erected vertically. The beam molds uses various types of connectors, the structural insulating core, the structural support members within the wall extending above the structural insulating core and the inner and outer boards. The column mold is also formed by the sides of the structural insulating core, connectors, support channels and flange extensions plus the inner and outer boards. Some connectors have air gaps at the flanges while other connectors have flange extensions added to form the air gaps at the connector ends. Some connectors have foam wrapped at their flanges while other have foam inserted at the interior side of the flanges. Some other connectors require dovetail joints recessed into the inner and outer boards because the connector end has a V shaped end with an air gap that slides into the recessed joint and another connector is twisted into that dovetail joint. Another type of connector requires vertical slots in the inner and outer boards for the connector to form the beam and column molds. Many of the same connectors and recessed joints are used in wall molds as well as used in precast concrete wall systems where the concrete is poured in a mold that is horizontal and erected vertically after the concrete has cured It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

The invention claimed is:

1. A column and beam forming wall mold system comprising:

an array of spaced apart flanged vertical metal support channels separated alternately by voids into which concrete is poured to form wall columns and insulating foam spacer blocks fully extending laterally between the channels, the channels extending above the top of the blocks creating a void into which concrete is poured to form a wall beam, the spacer blocks further alternately comprising full wall depth spacer blocks extending beyond the support flanges and narrow depth blocks extending between the flanges, the spacer blocks further comprising notches fully interfitted in the space between flanges, the spacer blocks further comprising notches fully interfitted in the space between flanges and mating grooves that encompass the channels; and inner and outer rigid boards attached to the flanges by fasteners passing through the boards from the outer surface, by longitudinal board grooves into which the flanges are fitted.

2. The system of claim 1, where flange extensions located in the beam and columns voids, wherein the extension create a hollow space adjacent the inner side of the flange into which a fastener end portion installed from the board outer surface dwells.

3. The system of claim 1, wherein flange hollow sections formed by turned in flange legs, the sections located in the beam and column voids, wherein the hollow sections create a space adjacent the inner side of the flange into which a fastener end portion installed from the board outer surface dwells.

4. The system of claim 1, wherein foam strips located adjacent the inner flange surface, wherein the strips form voids adjacent the inner side of the flange into which a fastener end portion installed from the boards outer surface dwells.

5. The system of claim 1, wherein twist connector channels formed by triangular shape flanges with extending legs with a shaft between, wherein the extending legs slides into the longitudinal board grooves of the inner and outer boards forming a column and beam mold.

6. The system of claim 1, wherein the bent flange connector channel between the inner and outer boards has a web with holes, flanges bent perpendicular to the web, lips bent parallel to the web, an angled flange bent to the web leaving a gap between the flange and the angled flange.

7. The system of claim 1, where the support channels have flange extensions located in the beam and column voids, wherein the extensions creates an additional flange, and forms a depression in a flange at the outer side of the U channel.

8. A column and beam forming wall mold system comprising:

an array of spaced apart flanged vertical metal support channels separated alternately by voids into which concrete is poured to form wall columns and insulating foam spacer blocks fully extending laterally between the channels, the channels extending above the top of the blocks creating a void into which concrete is poured to form a wall beam, the spacer blocks further alternately comprising full wall depth spacer blocks extending beyond the support flanges and narrow depth blocks extending between the flanges, the spacer blocks further comprising notches fully interfitted in the space between flanges, the spacer blocks further comprising notches fully interfitted in the space between flanges and mating grooves that encompass the channels; and inner and outer rigid boards attached to the flanges by fasteners passing through the boards from the outer surface, by longitudinal board grooves into which the flanges, and by connectors located in the beam void that are rotated into the board grooves.

9. The connectors according to claim 8 wherein can be of plastic.

10. The system of claim 8 where a twist connector has two connector ends, a shaft wherein the connector ends rotate within the longitudinal board grooves of the inner and outer boards forming a chamber for installing concrete comprising of:

inner and outer boards separated by a twist connector having two ends and a shaft with depressions; wherein the ends of the twist connector are inserted into longitudinal board groove, the shaft rotated 90 degrees connecting the ends of the twist connector with the sides of the longitudinal board groove, twist connector ends having a narrow width, a longer length, a shaft that connects to the center of the end of the twist connector, a shaft of the twist connector being less than or equal to the narrow width of the end of the twist connector; and the longitudinal board grooves having the width at the opening equal to the width of the twist connector, the depth being wider than the width of the opening having extending grooves at the end equal to the length of the connector end; and the connector ends having a narrow width equal the width of the longitudinal board groove, a length being sufficient to bind the sides allowing the narrow width to be inserted into the dovetail joints at the inner and outer board surfaces, the rotating the twist connector 90 degrees locking the twist connector into place.

11. The twist connector ends according to claim 10 wherein the connector ends can have a triangular flange head with extending legs as described in claim 5.

* * * * *